US006837282B2

(12) United States Patent
Navarro

(10) Patent No.: US 6,837,282 B2
(45) Date of Patent: Jan. 4, 2005

(54) APPARATUS FOR FILLING CONTAINERS WITH VISCOUS LIQUID FOOD PRODUCTS

(76) Inventor: Ramon Navarro, 4829 E. Walnut Ave., Orange, CA (US) 92869

( * ) Notice: Subject to any disclaimer, the term of this patent is extended or adjusted under 35 U.S.C. 154(b) by 0 days.

(21) Appl. No.: 10/208,495

(22) Filed: Jul. 29, 2002

(65) Prior Publication Data

US 2004/0016475 A1 Jan. 29, 2004

(51) Int. Cl.[7] ..... B65B 3/04

(52) U.S. Cl. ..... 141/170; 141/129; 141/165; 141/178; 141/181

(58) Field of Search ..... 141/129, 165, 141/168, 170, 178, 179, 181, 183, 188

(56) References Cited

U.S. PATENT DOCUMENTS

| | | | | |
|---|---|---|---|---|
| 1,737,677 A | * | 12/1929 | Pennock | 141/45 |
| 1,977,138 A | * | 10/1934 | Newey | 141/92 |
| 2,263,551 A | * | 11/1941 | Armstrong | 141/46 |
| 3,834,428 A | * | 9/1974 | Rademacher | 141/39 |
| 5,125,440 A | * | 6/1992 | Mette | 141/39 |

* cited by examiner

*Primary Examiner*—J. Casimer Jacyna
(74) *Attorney, Agent, or Firm*—Todd A. Vaughn, Esq.; William D. Breneman, Esq.; Breneman & Georges

(57) ABSTRACT

An apparatus for filling containers with viscous food product includes a plurality of pressure/vacuum fill head positioned above a plurality of containers. Each fill head includes a housing enclosing a plenum through which is longitudinally disposed a valve stem having in an outer cylindrical surface thereof a plurality of longitudinally disposed grooves terminated near a lower end of the stem by a cylindrical boss. The boss is biased into fluid pressure-tight sealing contact with a lower transverse end face of lower tubular portion of the housing by a helical compression spring which fits coaxially over a portion of the valve stem which protrudes upwardly from the housing, the spring being disposed between an upper transverse end wall of the housing, and the lower surface of a neck which protrudes radially outwardly from the upper end of the valve stem. Attached coaxially over the lower end portion of the fill head housing is a resilient circular sealing pad assembly which is compressed into a liquid pressure-tight sealing contact with a container rim, when a horizontally disposed press bar exerts a downward pressure on a resilient bumper at the upper end of the valve stem. Further downward motion of the press bar after downward motion of the valve housing is halted by contact with a container rim causes the valve stem to be displaced downwards within the housing against the restraining force of the compression spring, thus causing the boss at the lower end of the valve stem to extend outwardly from the lower housing seat. This causes an annular opening to be formed around the lower ends of the valve stem grooves, thus enabling pressurized liquid food product supplied to the head by a product inlet import protruding radially outward from the housing to flow into the container. Excess liquid food product and air displaced from the container are removed through a vacuum port which is disposed coaxially through the stem, the vacuum port having a lower opening which penetrates the lower end face of the valve stem, and an upper opening in the outer end of the neck which is connected to a vacuum source.

29 Claims, 26 Drawing Sheets

VACUUM PUMP
PRODUCT SUPPLY TANK
PRODUCT RECOVERY TANK
PRODUCT RECOVERY MANIFOLD
FILL HEAD
FILL HEAD
FILL HEAD
FILL HEAD
PRODUCT SUPPLY MANIFOLD
66
65
64
61
480
63
67
68
47
30A
48
50
32
45
46
43
44
62
60
483
484
481
482
56
$h_s$
$h_r$
$h_f$

VACUUM PUMP
PRODUCT SUPPLY TANK
PRODUCT RECOVERY TANK
PRODUCT RECOVERY MANIFOLD
FILL HEAD
FILL HEAD
FILL HEAD
FILL HEAD
PRODUCT SUPPLY PUMP
PRODUCT SUPPLY MANIFOLD
61
30B
47
50
32
46
43
60
62
484
52S
482
56

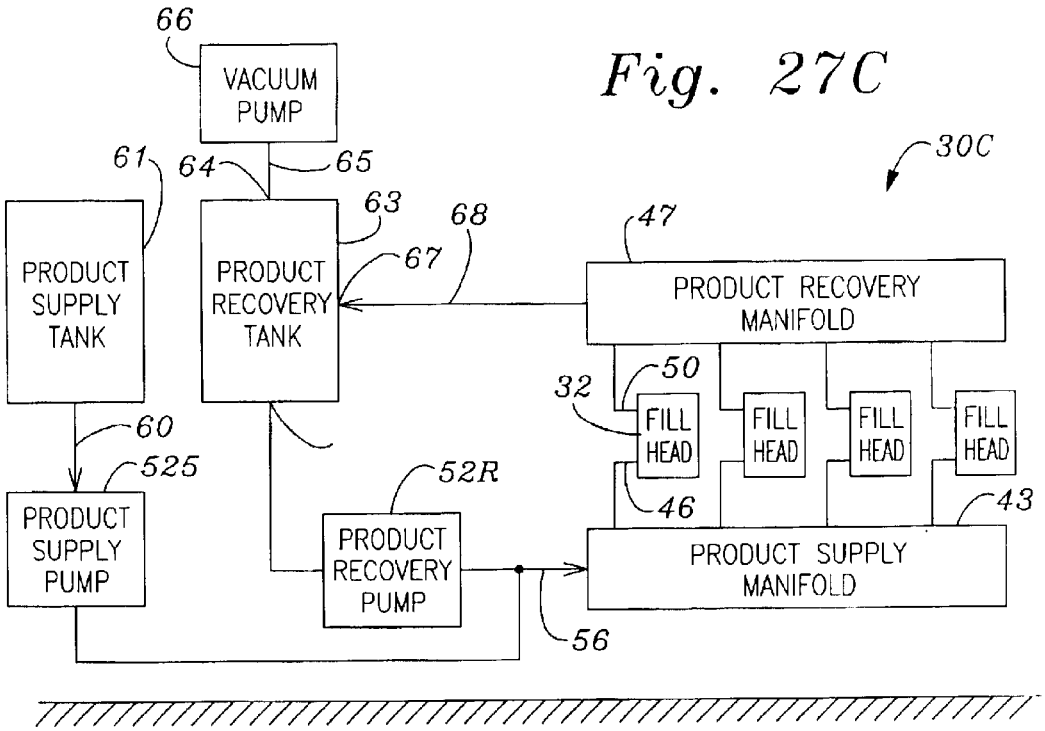
Fig. 27C
30C
66
VACUUM PUMP
61
64
65
63
68
47
67
PRODUCT SUPPLY TANK
PRODUCT RECOVERY TANK
PRODUCT RECOVERY MANIFOLD
50
32
FILL HEAD
FILL HEAD
FILL HEAD
FILL HEAD
60
525
52R
46
43
PRODUCT SUPPLY PUMP
PRODUCT RECOVERY PUMP
PRODUCT SUPPLY MANIFOLD
56

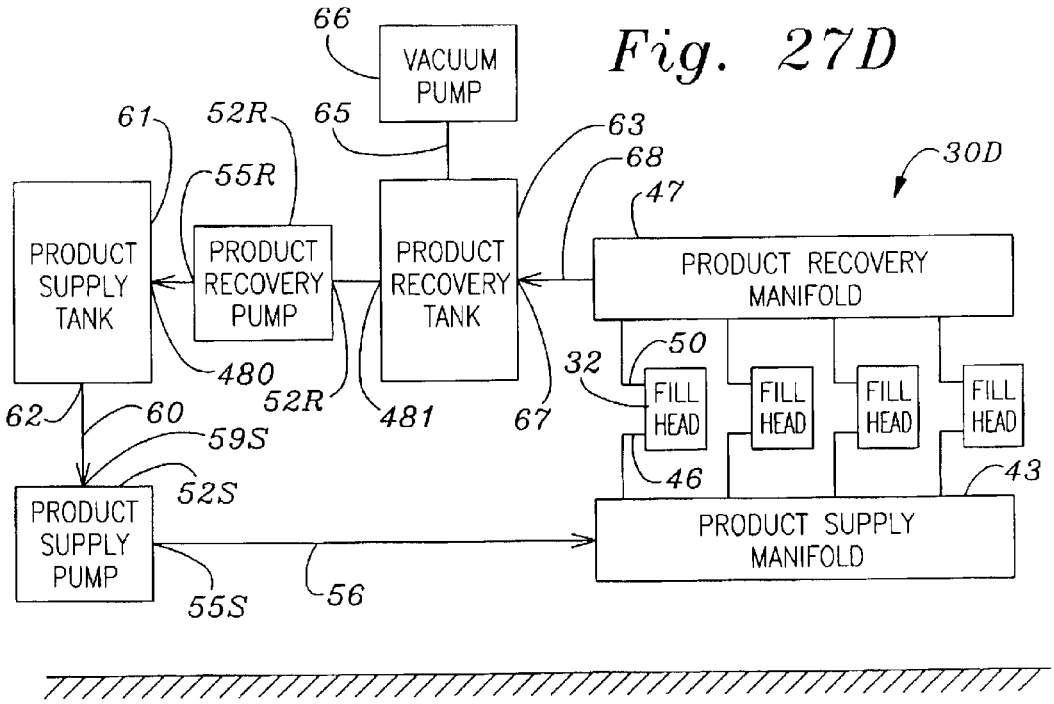
Fig. 27D
30D
66
VACUUM PUMP
61
52R
65
63
68
47
55R
PRODUCT SUPPLY TANK
PRODUCT RECOVERY PUMP
PRODUCT RECOVERY TANK
PRODUCT RECOVERY MANIFOLD
50
32
480
52R
481
67
FILL HEAD
FILL HEAD
FILL HEAD
FILL HEAD
62
60
59S
52S
46
43
PRODUCT SUPPLY PUMP
PRODUCT SUPPLY MANIFOLD
55S
56

Fig. 28
Fig. 29
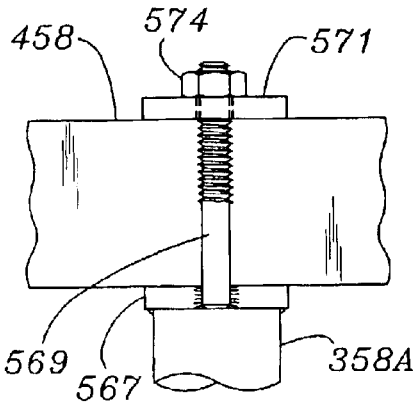
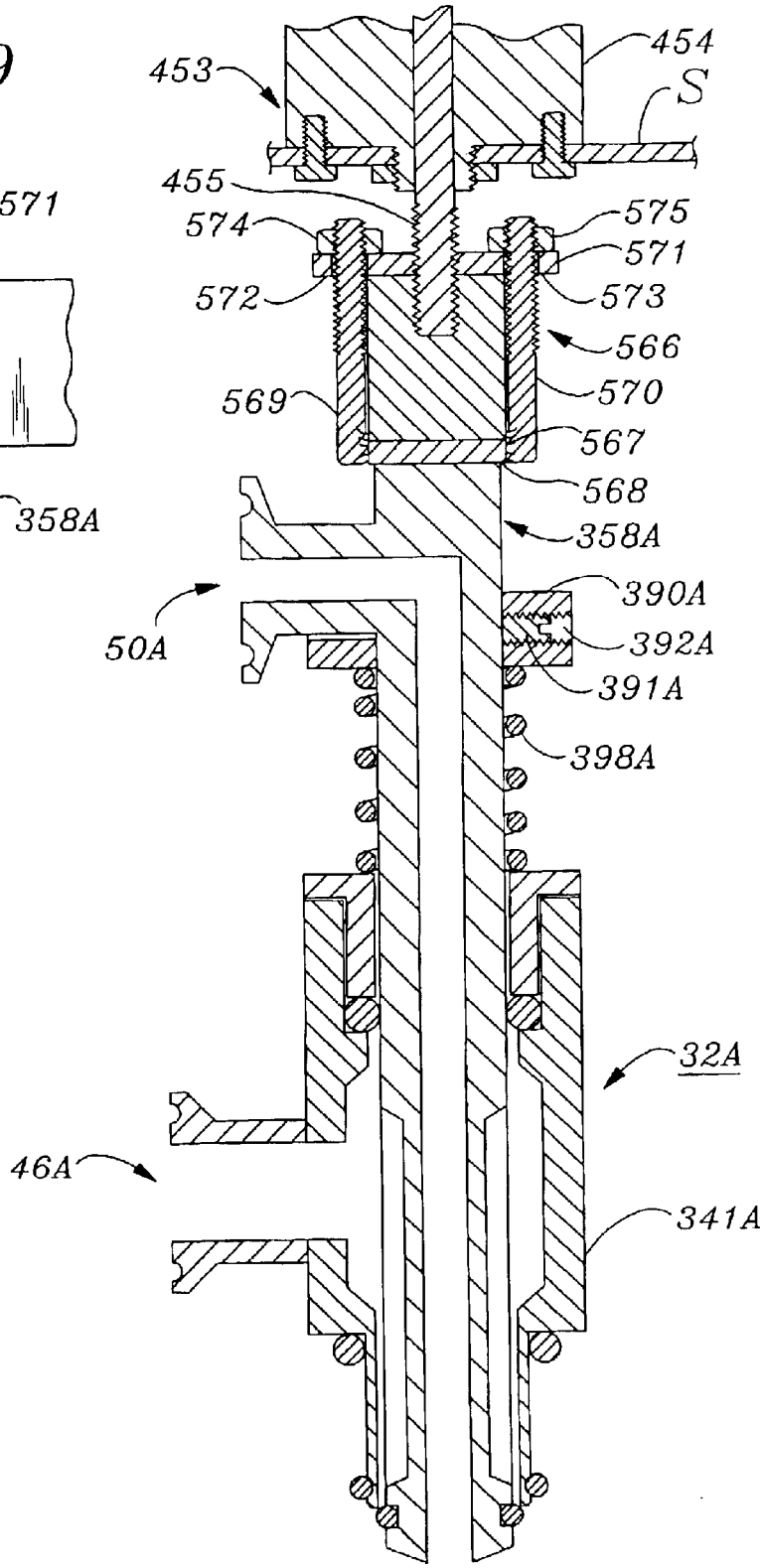

APPARATUS FOR FILLING CONTAINERS WITH VISCOUS LIQUID FOOD PRODUCTS

BACKGROUND OF THE INVENTION

A. Field of the Invention

The present invention relates to methods and apparatus used in manufacturing production lines for filling containers such as bottles and cans with liquid food products. More particularly, the invention relates to an apparatus for rapidly filling quantities of containers with a variety of liquid food products which have different viscosities, such as beverages and jellies.

B. Description of Background Art

A wide variety of machines are used in product packaging lines for filling containers with liquid products. Ideally, such machines are capable of filling large quantities of containers with liquid products in a short time. In a typical installation of a machine for rapidly filling large quantities of containers with liquid products, empty containers are transported to the machine by an inlet conveyor, where a rotary or in-line arrangement of fill heads dispense liquid products simultaneously into individual containers. Obviously, the throughput rate of this batch processing technique exceeds that of a container filling method in which individual containers are filled one at a time.

After a batch of containers is filled with liquid product as described above, the filled containers are transported away from the filling machine, by an outlet conveyor, for example, for subsequent processing including the installation of caps or lids on the containers, attachment of labels, and placement of the containers into boxes for shipping.

A variety of liquid product delivery systems are used in liquid product filling machines, including gravity or pressure feed, and the quantity of liquid product delivered to a container is controlled by various methods such as timed flow, container fill-level control or volumetric, in which a predetermined quantity of liquid product is dispensed into each container having a predetermined volume.

Liquid product filling machines used in the food and drug industries for filling containers with food and drug products, especially those intended for human consumption, must meet performance requirements in addition to those of liquid filling machines of the type alluded to above. For example, U.S. Food and Drug Administration (FDA) regulations require that machines used to fill containers with liquid food or drug products must be sterilizable, and readily cleaned of liquid products which might be trapped in cavities within machine parts, and thereby providing a growth media for microbes. Accordingly, a goal in the design and construction of production line filling machines for liquid food products is that such machines be Cleanable In Place (C.I.P.), with no or minimal disassembly of machine components required.

Although not required by FDA regulations, liquid filling machines for use with food products desirably would also be able to accommodate products having a wide range of viscosities, including very viscous products such as jellies and low-viscosity products such as beverages. The present inventor is unaware of any existing liquid product filling machine which is capable of rapidly filling containers with liquid food products which have a wide range of viscosities, which also meets C.I.P. requirements.

Machines relating generally to the field of the present invention include: Weiss, U.S. Pat. No. 5,501,253, which discloses an apparatus for filling vessels with liquid. The disclosed apparatus is intended primarily for use in filling bottles with carbonated beverages, and uses a counterpressure fill head that includes a valve stem retractable in a valve body to allow liquid under pressure to flow through an annular opening made between the valve stem head and a valve seat within the tubular valve housing, into a bottle pressed into sealing contact with a resilient seal attached to the lower end of the valve housing. Excess gas in the bottle is evacuated through a central bore provided through the valve stem. No means are disclosed to adapt the apparatus to handle viscous liquid food products, or how to make the apparatus meet C.I.P. requirements.

Kiholm, U.S. Pat. No. 6,135,167, discloses a method and apparatus for a filler valve, which includes a valve stem head provided with circumferentially spaced apart radial ports for dispensing liquid food product from a central bore connected to a produce inlet port, to the interior of a bottle. Air displaced from the container by liquid product injected into the container is exhausted into a co-axial annular space between a tubular slider housing which longitudinally slidably holds the valve stem, the slider housing having at the lower end thereof a resilient annular sealing cap for compressively contacting the rim of a bottle or similar container. No means are disclosed for evacuating excess viscous liquid product from a container being filled.

The present invention was conceived of to provide a machine for rapidly filling batches of containers of various sizes and shapes with liquid food products having a wide range of viscosities.

OBJECTS OF THE INVENTION

An object of the present invention is to provide an apparatus for rapidly filling quantities of containers with viscous and non-viscous liquid food products.

Another object of the invention is to provide an apparatus for filling a container with a liquid food product, in which air and excess liquid product are simultaneously exhausted from a container being filled, thus maximizing container fill rate.

Another object of the invention is to provide an apparatus for filling a container with liquid food product, for simultaneously exhausting air and excess product from the container, and for transporting excess liquid product to a product recovery tank.

Another object of the invention is to provide an apparatus for rapidly filling batches of containers with liquid food products having a wide range of viscosities.

Another object of the invention is to provide an apparatus for filling a row of containers with liquid food products, in which a single press bar is used to simultaneously press down on a row of fill heads to thereby force the fill heads into resilient compressive contact with individual containers, a valve stem on each fill head being pressed downwardly by the press bar into a container to thereby open a valve and dispense liquid into a container, the valve head remaining seated and closed within a valve housing if no container is present to oppose downward motion of the housing.

Another object of the invention is to provide an apparatus for filling containers with liquid products which utilizes a plurality of pressure/vacuum fill heads, each head having a housing which slidably holds a valve stem having in a lower end portion thereof a plurality of circumferentially spaced apart, longitudinally disposed grooves which provide channels for rapid transfer of viscous liquids into a container into which a lower portion of the fill head housing is inserted, when the lower end of the valve stem is pushed outwards from sealing contact within the lower end of the fill head housing to thereby unblock lower ends of the grooves.

Another object of the invention is to provide an apparatus for filling containers with liquid food products which utilizes a plurality of pressure/vacuum fill heads, each having a housing which longitudinally slidably holds a valve stem that has a relatively large diameter central bore connected through a vacuum port to a vacuum source, thereby facilitating rapid evacuation of air and excess food product from a container being filled.

Another object of the invention is to provide an apparatus for rapidly filling quantities of containers with liquid food product which includes a plurality of pressure/vacuum heads, each connected to a pressurized product supply inlet manifold supplied with liquid food product from a double acting positive displacement piston pump, and a vacuum manifold which transfers air displaced air and excess liquid food product from containers being filled to a product recovery tank, the recovered excess liquid food product optionally being re-circulated to the product supply inlet manifold.

Another object of the invention is to provide an apparatus for rapidly filling quantities of containers with liquid food products which may have various viscosities, the apparatus including a filling machine which includes a row of pressure/vacuum fill heads simultaneously operated by a single press bar, each of the fill heads having a product inlet port connected to a product supply inlet manifold, and a vacuum outlet port for excess product connected to a vacuum manifold, and a double acting piston pump connected through inlet check valves to a product supply tank, and through outlet check valves to a product supply line which delivers liquid product to the product supply manifold, each of the components of the apparatus having no cavities in which food product might be trapped, and each component of the apparatus being readily cleanable in place (C.I.P.), and readily disassembled and reassembled for inspection.

Another object of the invention is to provide a double action piston pump for pumping liquid food products which has no cavities in which liquid food product might be trapped and thereby provide a growth media for microbes, and which is quickly and easily disassembled for cleaning, and re-assembled for use, without using tools.

Another object of the invention is to provide a check valve for use in controlling flow direction in streams of viscous liquid food products which has no cavities in which liquid food product might be trapped and thereby provide a growth media for microbes, and which is quickly and easily disassembled for cleaning, and re-assembled for use, without using tools.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends an apparatus for filling containers with liquid products, particularly liquid food products. A liquid filling apparatus according to the present invention includes a container filling machine which utilizes a plurality of novel pressure/vacuum fill heads for simultaneously filling a plurality of containers of various types, including bottles and jars, with a variety of liquid food products having different viscosities, ranging from highly viscous products such as jellies, to low viscosity products such as beverages.

An apparatus according to the present invention also includes a novel positive displacement, double action piston pump, and a plurality of novel check valves. The fill heads, pump and check valves function cooperatively to rapidly fill quantities of bottles or containers with liquid food products of various viscosities, while avoiding the introduction of air into the product pumped. According to the invention, excess liquid food product dispensed into a container is evacuated from the container, along with air or suds. Excess food product in a container is exhausted through the fill head to a product recovery tank which is connected to a vacuum pump. Liquid food product is supplied from a product supply tank to the piston pump through an inlet check valve. Optionally, the product supply tank is connected to the product recovery tank. With this arrangement, excess food product is recirculated rather than being wasted. The novel design and construction of the fill heads also facilitates exhaustion of air and suds from a container being filled.

Each pressure/vacuum fill head according to the present invention includes a generally cylindrically-shaped valve housing which longitudinally slidably holds a valve stem. The valve stem is biased upwards to a sealed, closed position within the housing by a helical compression spring. The container filling machine includes a fill head press bar which pushes downward by a pneumatic actuator cylinder onto an upper end of each valve stem, causing the valve stem spring and housing to move downwards in unison towards a support platform holding a row of containers to be filled.

Each fill head housing has attached to the lower end thereof a larger diameter, annular ring-shaped seal holder body which holds a stack of resilient annular washer pads of selectable thickness that compressively contact the rim of a container and forms an air-tight compressive seal therewith. When the valve stem is depressed, downward motion of the seal holder body and its resultant contact with a container rim limits the downward travel of the seal holder body to the height of the container, causing the valve stem to compress the spring and travel further downwards into the interior of the container in unison with the fill head press bar. Extension of the valve stem below an annular valve seat at the lower annular edge wall of a lower tubular portion of the fill head housing creates an annular open space between the lower end of the valve stem and the housing. This annular-shaped opening allows pressurized liquid food product conveyed to an inlet port on the valve housing into a plenum within the housing which surrounds the valve stem, to flow through a plurality of circumferentially spaced apart, longitudinally disposed grooves in the valve stem body, through the annular opening and into the interior of the container.

Each pressure/vacuum fill head includes a vacuum/product return bore disposed longitudinally through the center of the valve stem, the upper end of the bore being connected by an upper, vacuum/product-return port to a product recovery manifold, which is in turn connected to a product recovery tank that is connected to a vacuum pump.

The apparatus includes a novel clean-in-place (CIP) double action piston pump which includes a cylinder sealed by front and rear head plates which are attached to the cylinder by front toggle and rear toggle clamps which may be quickly and easily released without tools to enable disassembly of the pump for cleaning, and re-attached to the cylinder to prepare the pump for use. The pump includes a piston reciprocable by an external double action pneumatic actuator cylinder coupled to a piston rod protruding rearward through a rear end plate of the pump, between front and rear travel limits. The pump includes a pair of front and rear cylinder ports which communicate with a front portion of the cylinder bore forward of the forward piston travel limit, and rearward of the rear piston travel limit, respectively. Thus, liquid food product is drawn into the pump cylinder bore through the front port during a piston backstroke, while liquid product in the rear portion of the bore is expelled through the rear port. Similarly, liquid food product is drawn into the rear portion of the pump cylinder bore during forward motion of the piston, while liquid food product in the front portion of the bore is expelled through the front cylinder port. Increased pump pressure required for pumping substantially viscous liquid food products is obtained by applying greater actuation force on the piston rod by the external actuator. Decreases and increases in pumping flow rates are achieved by decreasing and increasing the piston stroke length between the front and rear travel limits, and/or by decreasing or increasing the actuator reciprocation rate. The apparatus preferably includes a double action pneumatic pump actuator cylinder which is powered by compressed air, pressurized air being directed into front/rear, pull/push ports of the actuator cylinder by a novel configuration of control valves actuated by motion of the piston rod to comprise a pneumatic analog of an astable multivibrator of adjustable amplitude and frequency.

The apparatus includes novel check valves which are used interchangeably as inlet and outlet check valves. A first pair of outlet check valves is connected to forward and rear ports of the pump cylinder, the ports being located on front and rear sides of a reciprocable piston in the cylinder, and in line with two outlet tubes that merge into a single output pipe which comprises a product outlet manifold for supplying pressurized liquid product to the fill head product supply inlet manifold on the filling machine. Also, a second pair of inlet check valves is connected to the forward and rear pump ports, in line with two inlet tubes of a product inlet manifold that Y off from a single product supply inlet pipe which is connected to a product supply reservoir tank.

Each check valve includes a hollow, generally cylindrically-shaped housing comprised of similarly-shaped hollow, generally cylindrically-shaped lower and upper inlet and outlet halves which are releasably and sealably fastened together at their respective upper and lower transverse end walls by a toggle clamp. The lower, inlet half of the housing has an upwardly and outwardly tapered, circular inner wall which serves as a valve seat for the lower portion of a circular valve body, the latter having a circumferential groove in which is fitted a resilient O-ring that sealingly contacts a valve seat area of the inner wall. The valve body includes a stem which protrudes coaxially and perpendicularly upwards from the circular lower portion of the valve body. The valve also includes a bushing, coaxially held within the upper half of the housing, which axially slidably receives the upper end of the valve stem. A helical compression spring fitting coaxially over the valve stem and disposed between the lower face of the bushing and the upper face of the lower portion of the valve body biases the valve to a downward, closed position, the valve opening when upwardly directed, inlet hydrostatic pressure on the valve body exceeds the downward directed pressure exerted on the valve body by the spring. The toggle clamp joining the two halves of the valve housing is quickly and easily removable to enable disassembly, cleaning, and re-assembly of the valve.

Each component of the apparatus is devoid of cavities in which liquid fool product might be trapped and thereby cause contamination, and the entire apparatus is constructed to facilitate Cleaning In Place (C.I.P.) of the apparatus without disassembly.

BRIEF DESCRIPTION OF THE DRAWINGS

FIG. 15 is a fragmentary front elevation view of the apparatus of FIG. 2, on an enlarged scale in which

FIG. 16 is a fragmentary rear view of the apparatus of FIG. 15, in which

FIGS. 27A–27D are schematic diagrams showing flow paths for liquid products in various embodiments of the apparatus of FIG. 1, in which FIG. 27A illustrates a modification of the apparatus which does not require a pump. FIG. 27B illustrates a basic embodiment of the apparatus which uses a product supply pump, FIG. 27C illustrates another embodiment of the apparatus which uses a product supply pump and a product recovery pump, and FIG. 27D illustrates a preferred embodiment of the apparatus which uses a product supply pump and product recovery pump in a different configuration from that shown in FIG. 27C.

FIG. 28 is a vertical medial sectional view of a modified fill head and actuating structure therefor, according to the present invention.

FIG. 29 is a fragmentary side elevation view of the structure of FIG. 28, taken in the direction of line 29—29.

DESCRIPTION OF THE PREFERRED EMBODIMENTS

Figure 1A:
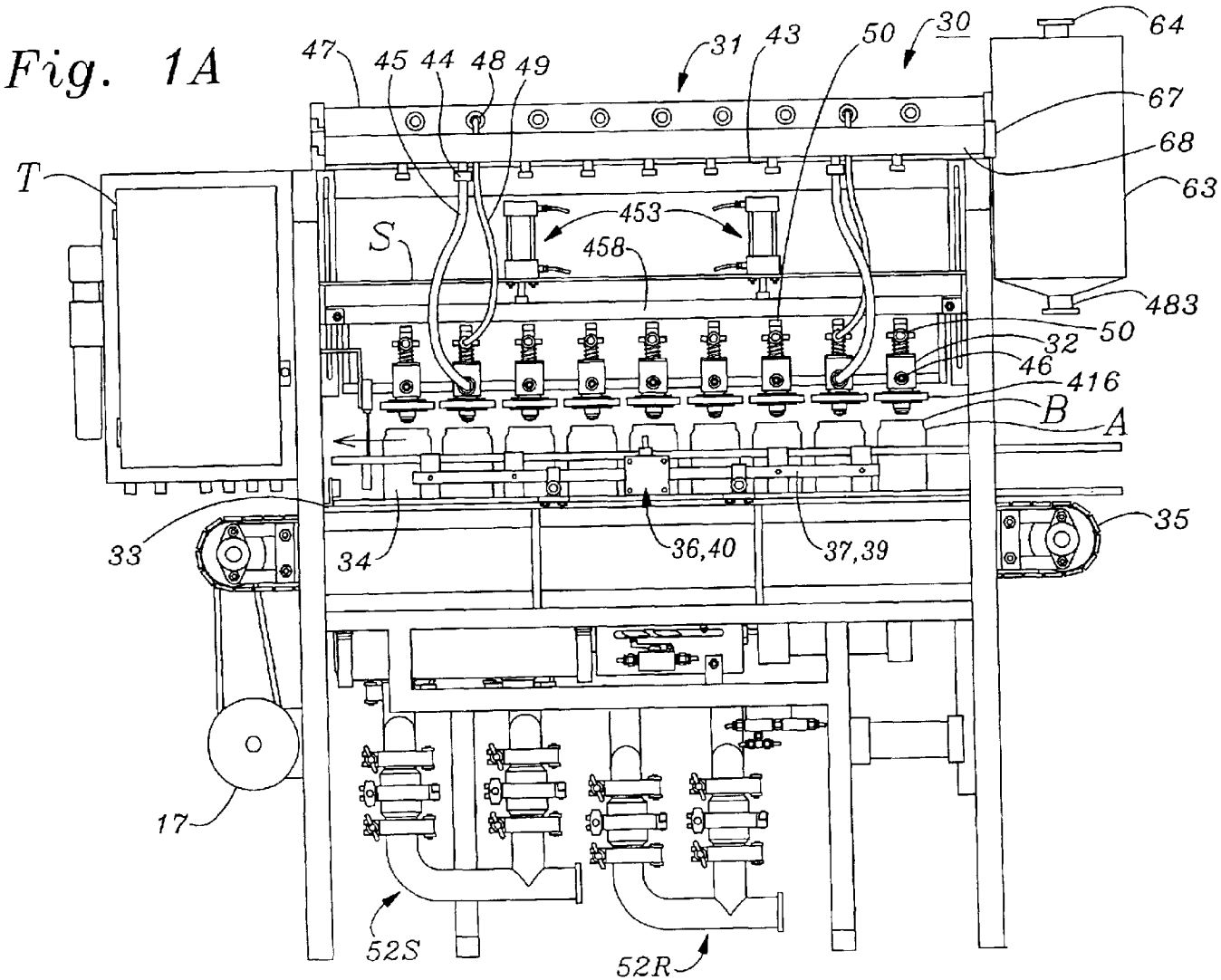
FIG. 1A is a front perspective view of an apparatus for filling containers with liquid food products of various viscosities according to the present invention.
Figure 1B:
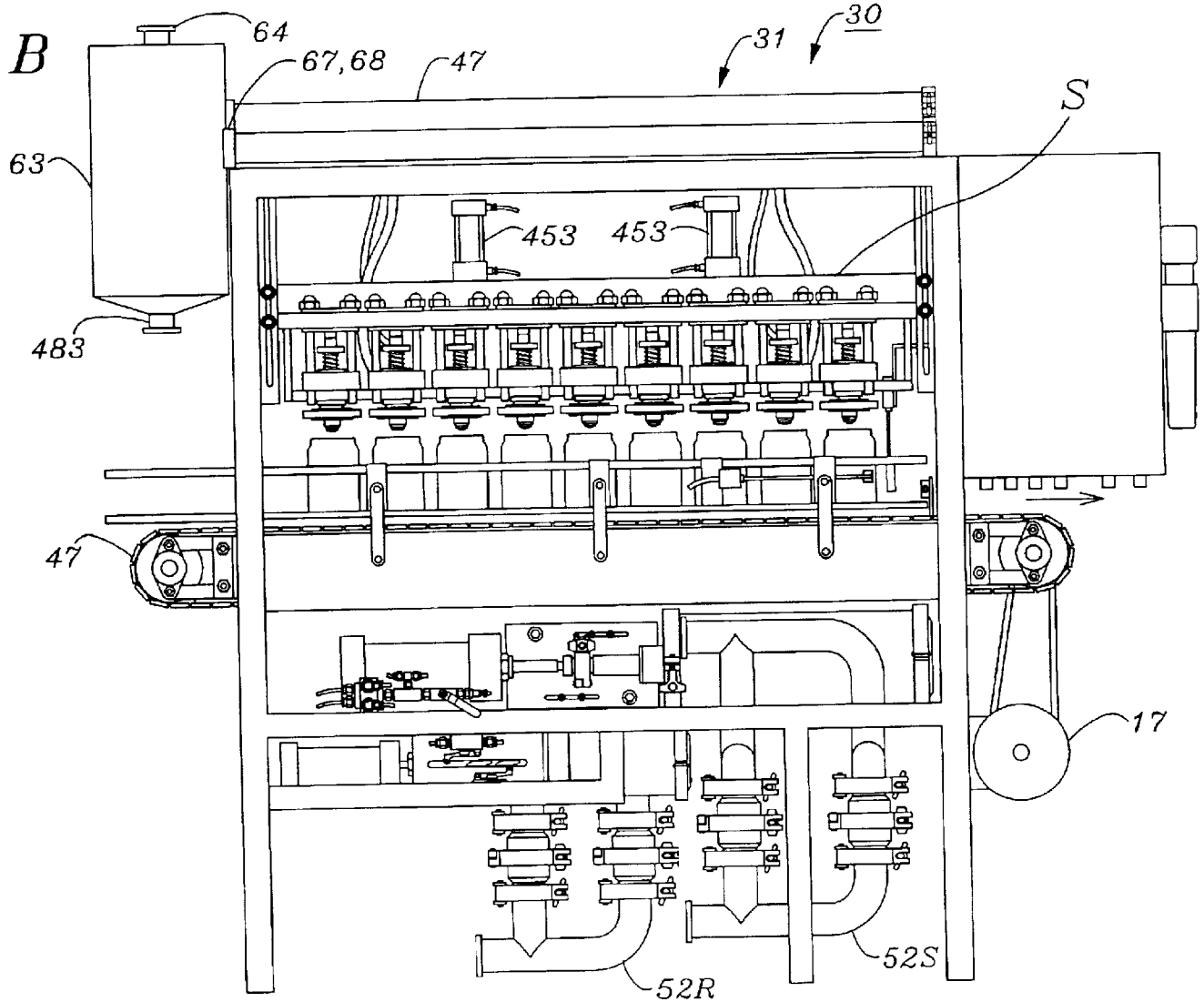
FIG. 1B is a rear view of the apparatus of FIG. 1A.
Figure 1D:
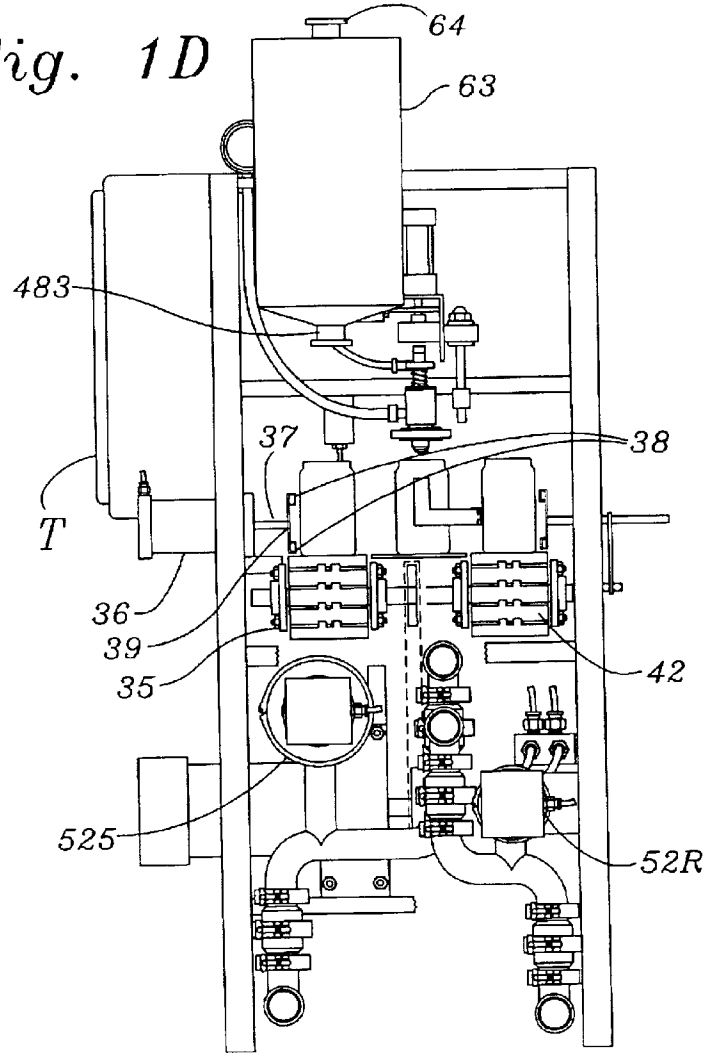
FIG. 1D is a left side view of the apparatus of FIG. 1A.
Figure 1C:
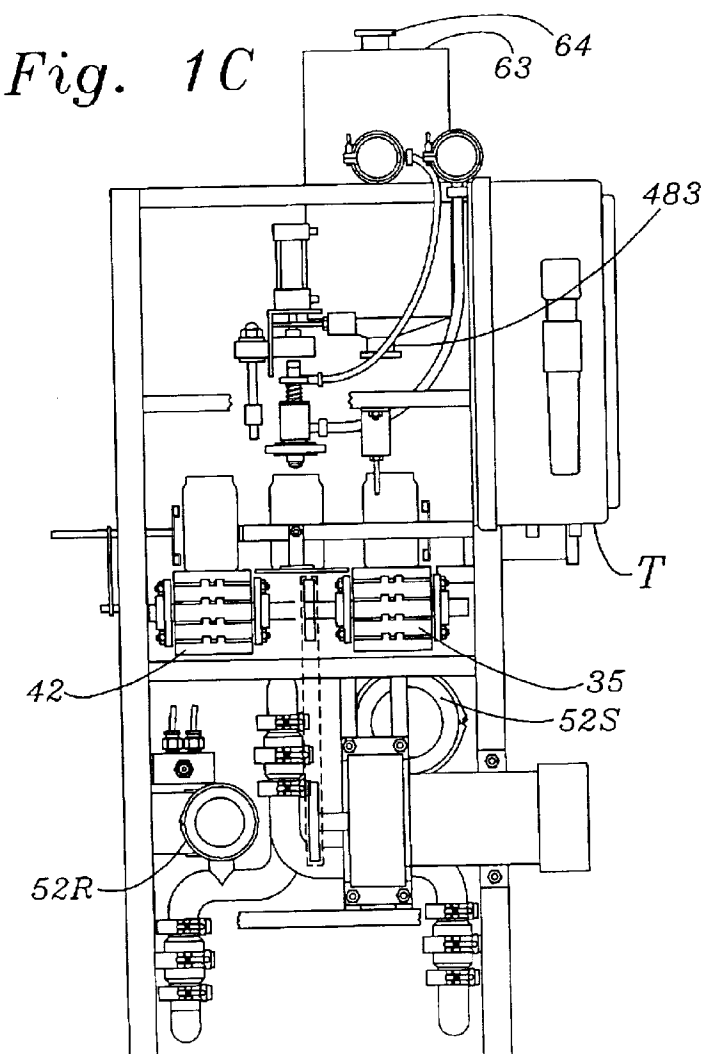
FIG. 1C is a right side view of the apparatus of FIG. 1A.
Figure 1E:
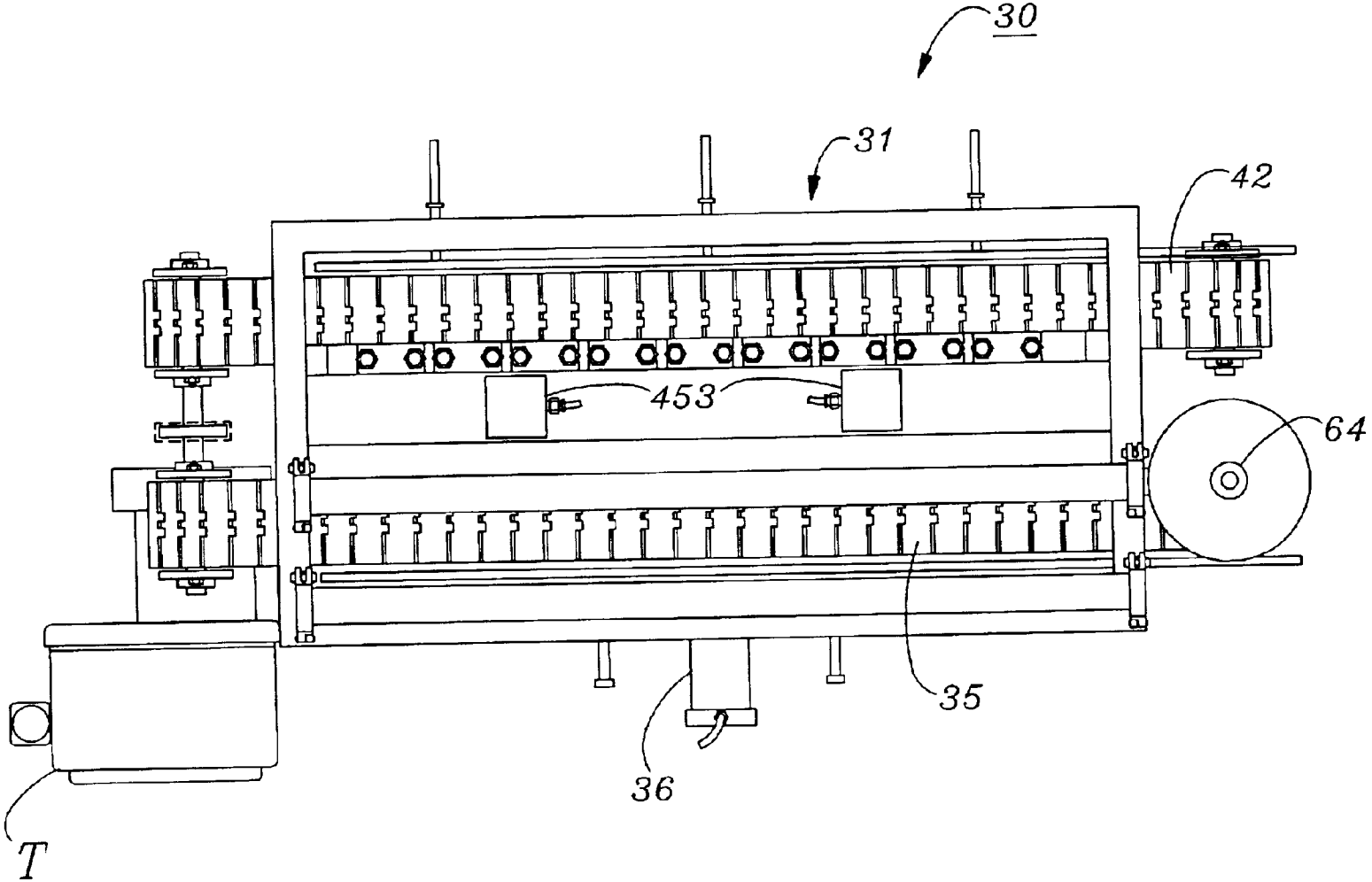
FIG. 1E is an upper view of the apparatus of FIG. 1A.

FIGS. 1–29 illustrate various aspects of an apparatus for filling containers with liquid food products according to the present invention.

FIGS. 1A–1E illustrate a preferred embodiment or an apparatus 30 for filling containers with liquid food products according to the invention, in which certain hoses, electrical cables and the like have been removed for clarity.

As shown in FIGS. 1A–1E, a preferred embodiment of an apparatus 30 for filling containers with liquid food products according to the present invention includes a filling machine 31 which utilizes a plurality of novel pressure/vacuum fill heads 32 arranged in a row above a support plate or filling platform 33. A first plurality or "batch" of containers 34 arranged in a row is transported into position parallel to and along side filling platform 33 by an inlet conveyor belt 35, that position serving as an inlet or loading "platform" for empty containers. The empty containers are then pushed laterally inwardly onto filling platform 33 and into position below individual fill heads 32 by a horizontally disposed indexing pusher actuator 36 which includes an arm 37, bumpers 38 located on the inner vertical surface of a plate 39 attached to the end of the arm, and a pneumatic actuator cylinder 40 connected to the arm. The arm is then retracted, and a second batch of containers 34 is then transported into the loading position adjacent to filling platform 33. After containers 34 have been simultaneously filled by fill heads 32 in a manner which will be described in detail below, pneumatic actuator cylinder 40 is again energized to extend actuator cylinder piston rod 41, thus causing the second batch of empty containers to be pushed inwards towards the fill heads, and thus pushing filled containers 34 onto an adjacent portion of conveyor belt 42, which serves as an outlet, unloading platform. A conveyor drive mechanism is then activated, conveying the filled containers to other production line stations for installing caps on the containers, and ultimately loading them into shipping containers. Piston rod 41 of pneumatic cylinder 40 is once again retracted inwards to its home position, preparatory to pushing a third batch of containers 34 into place beneath fill heads 32, and thus completing a container batch fill cycle.

As shown in FIGS. 1A–1E, machine 31 of apparatus 30 includes a pressurized fill head product supply inlet manifold 43 which has a plurality of individual outlet ports 44 that are connected by hoses 45 to inlet ports 46 of individual fill heads 32. Machine 31 also includes an excess product return manifold 47 which has a plurality of individual inlet ports 48 that are connected by hoses 49 to outlet ports 50 of individual fill heads 32.

As shown in FIGS. 1A–1E, machine 31 of apparatus 30 includes certain components whose construction and functions are well known to those skilled in the art, and which, therefore, will not be described in detail. Thus, machine 31 includes a motor M for driving inlet and outlet conveyors 35, 42, and an electronic timing and control box T which issues pre-programmed signals to various solenoid valves required for operation of pneumatic force actuator cylinders of the machine, as will be readily understood by those skilled in the art. Machine 31 also includes various sensors for sensing the presence of containers in the machine, such as longitudinal position sensor LOS and lateral position sensor LAS, which input signals to timing and control box T that are used by logic circuitry to condition command signals issued to various control valves.

Figure 10:
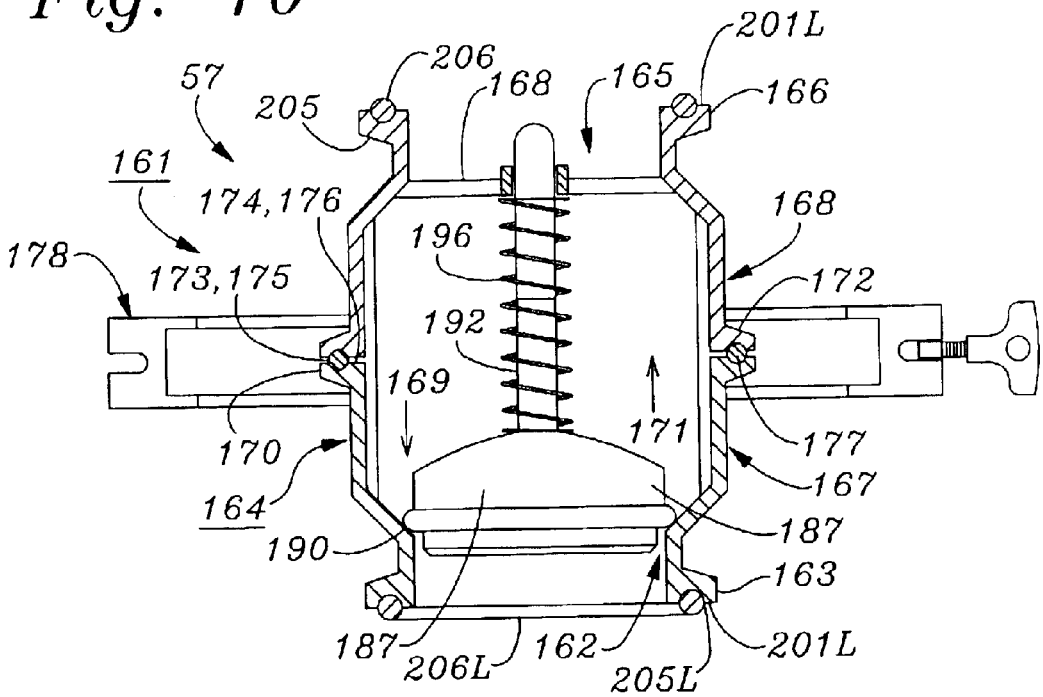
FIG. 10 is a fragmentary vertical sectional view of a novel check valve of the apparatus of FIG. 9A, taken in the direction of line 10—10.
Figure 12:
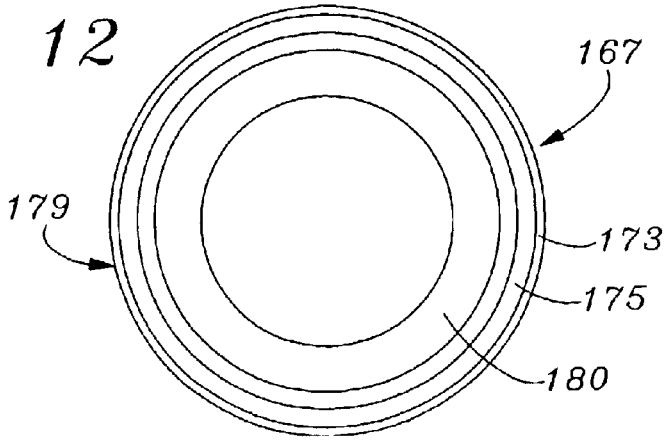
FIG. 12 is an upper plan view of a lower insert of the valve of FIG. 10.
Figure 13:
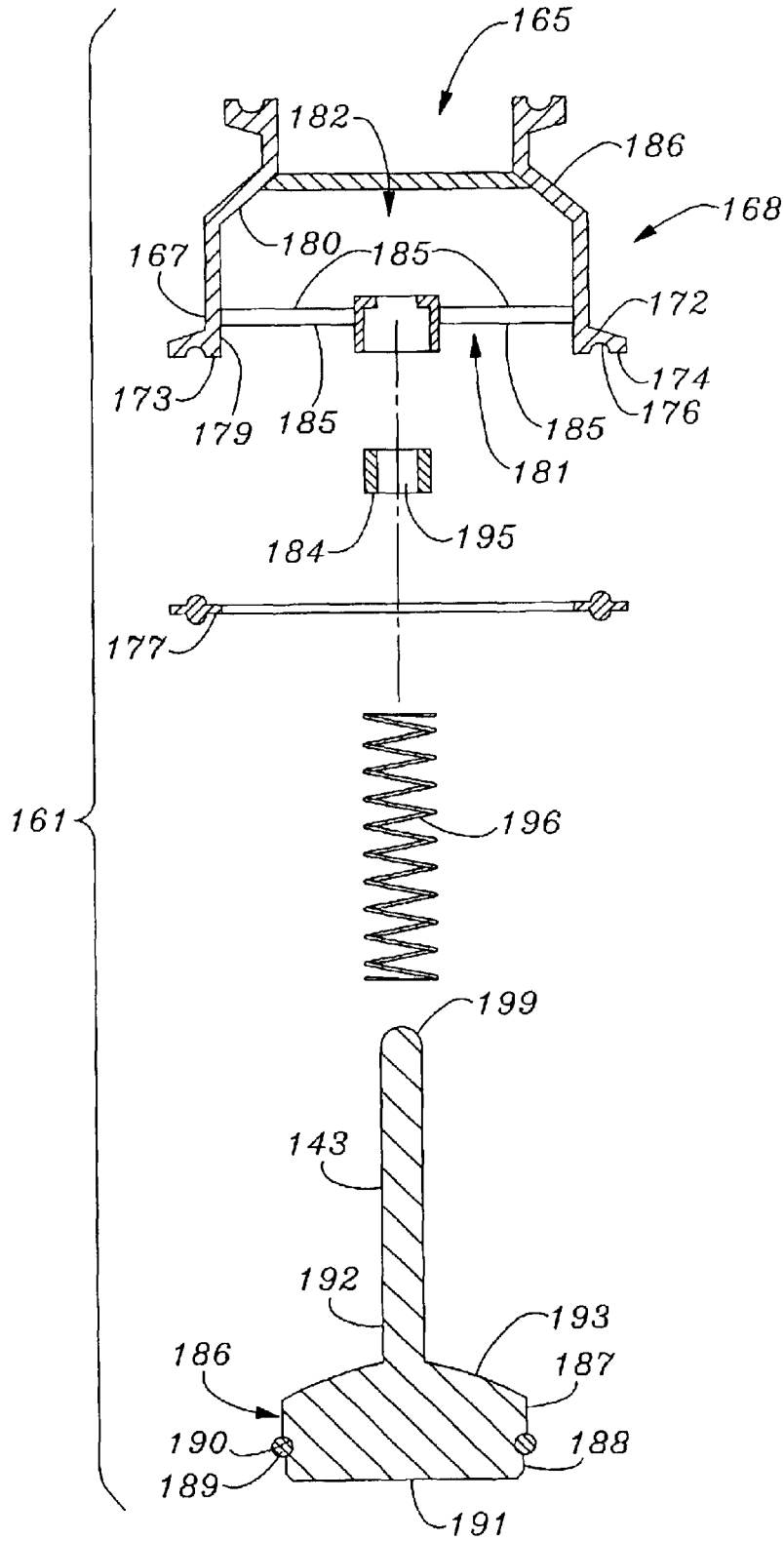
FIG. 13 is a fragmentary exploded vertical sectional view of the valve of FIG. 10.
Figure 14:
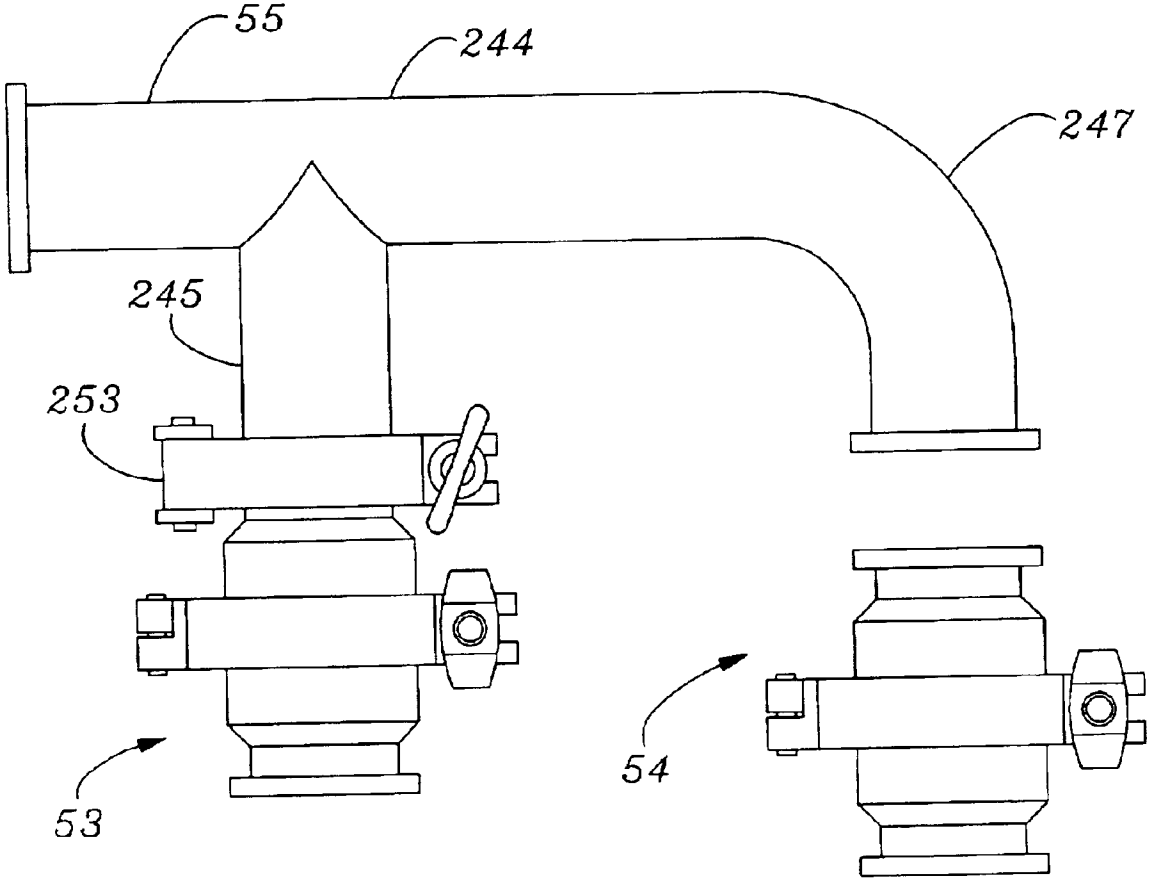
FIG. 14 is a fragmentary front elevation view of the apparatus of FIG. 2, showing an outlet manifold thereof.
Figure 22:
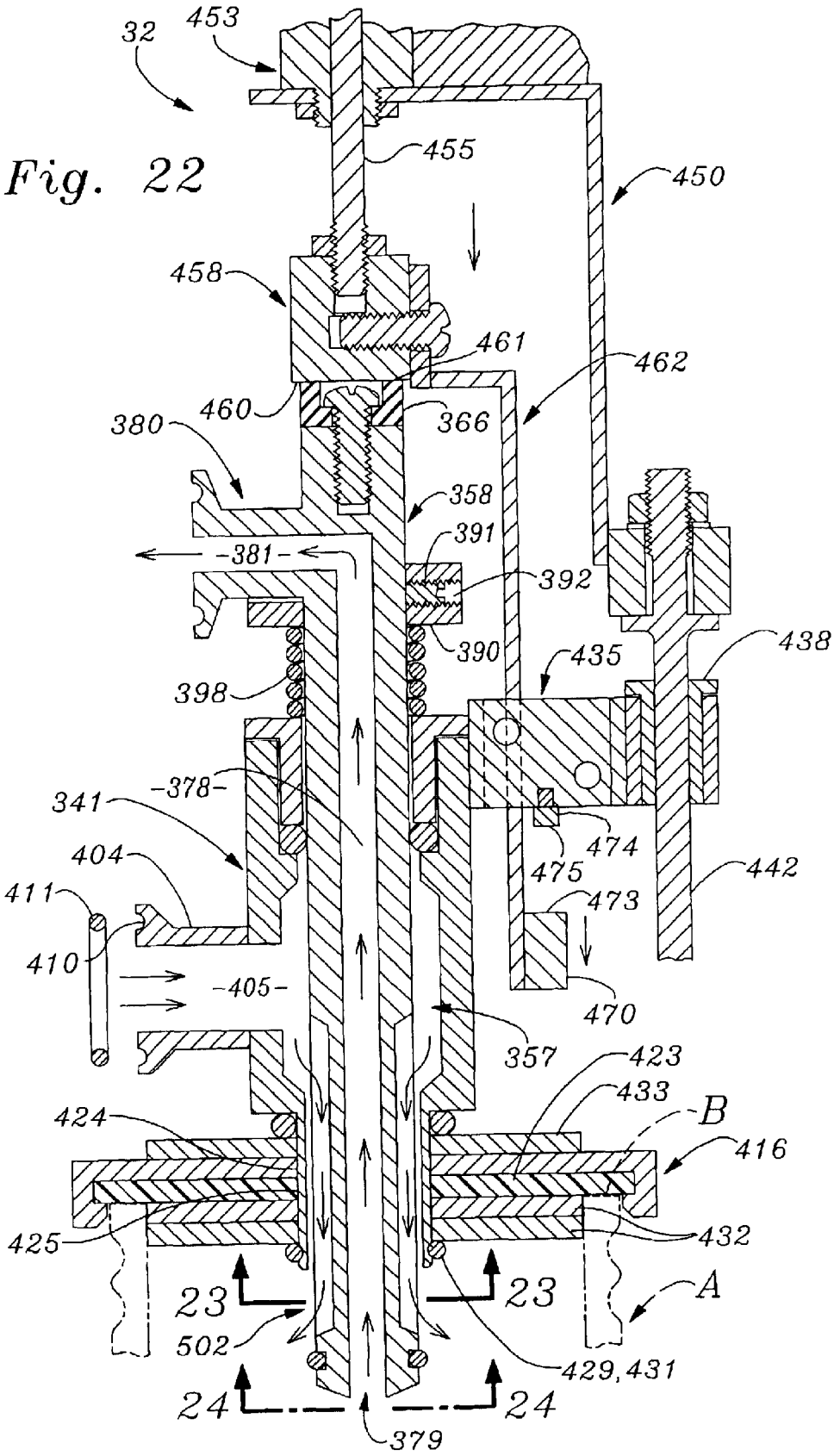
FIG. 22 is a view similar to that of FIG. 21, but showing a valve stem comprising part of the fill head moved downwards to an active filling disposition, and a sealing disk of the fill head in compressive contact with the rim of a container.

As shown in FIGS. 10 and 22, machine 31 includes a container outlet guide rail 490 disposed parallel to and above outlet conveyer belt 42. Outlet guide rail 490 has attached to an inner vertical surface thereof a pair of longitudinally disposed bumpers 491. Also, outlet guide rail 490 has protruding from an outer vertical wall surface thereof a support rod 492 telescopically adjustably held in a bushing 493 fitted in a vertical support structure 53 of the machine 31, to adjust the position of the rail to bear against containers of various diameters.

Figure 2:
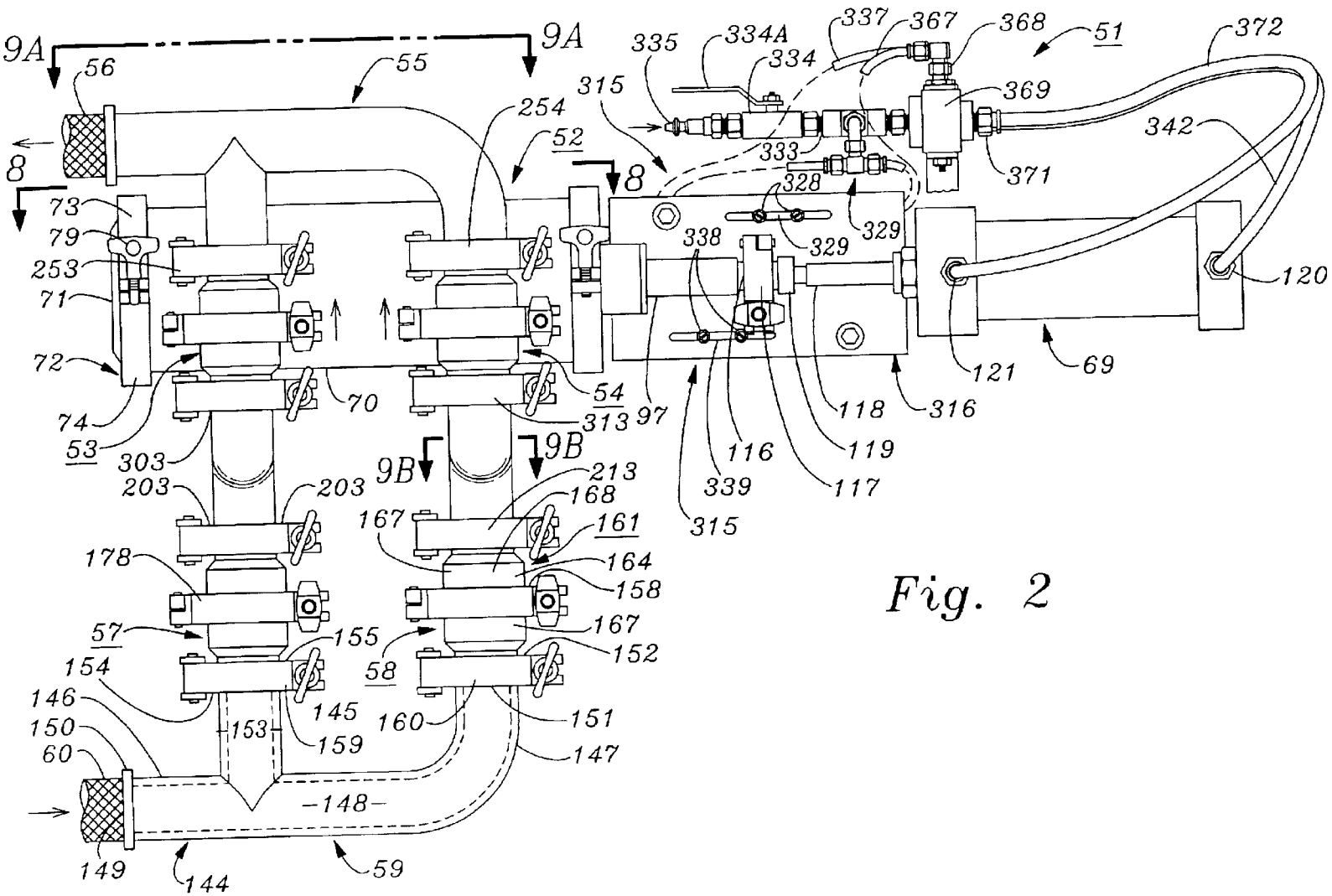
FIG. 2 is a front elevation view of a pump, valves, and manifolds comprising a pumping machine part of the apparatus of FIGS. 1A–1E.

Referring now to FIG. 2 in addition to FIGS. 1A–1E, it may be seen that apparatus 30 according to the present invention includes in addition to filling machine 31 a pumping machine 51. The latter includes a novel double action piston pump 52 connected through a pair of upper front and rear outlet check valves 53, 54 to a pump outlet manifold 55, which is in turn connected to product supply inlet manifold 43 by a pressurized product supply hose 56. Pump 52 is also connected through a pair of novel lower front and rear inlet check valves 57, 58 to a pump inlet manifold 59. The latter is connected by a low pressure product supply hose 60 to an outlet port 62 of a product supply tank 61.

Apparatus 30 also includes a product recovery tank 63 which has a vacuum port 64 that is connected through a vacuum hose 65 to a vacuum pump 66, and a product return inlet port 67 which is connected by a low pressure product return hose 68 to excess product return manifold 47. Optionally, product recovery tank 63 may be coextensive with product supply tank 60, allowing recirculation of excess product. Pump 52 is powered by a double acting pneumatic pump actuator cylinder 69 in a manner which will be described in detail below.

Figure 25:
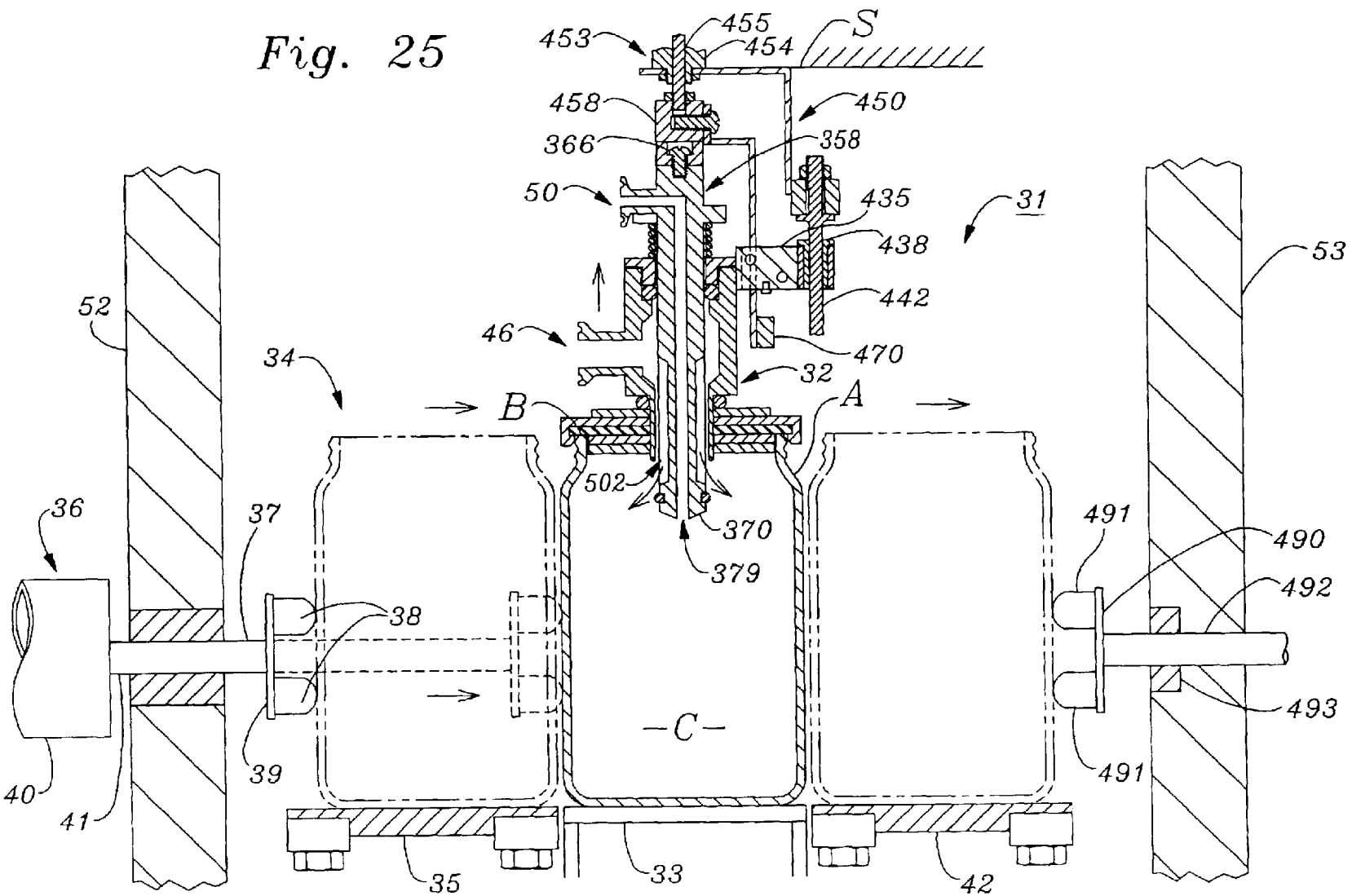
FIG. 25 is a transverse sectional view of the filling machine of FIG. 1, taken along line 25—25.
Figure 26:
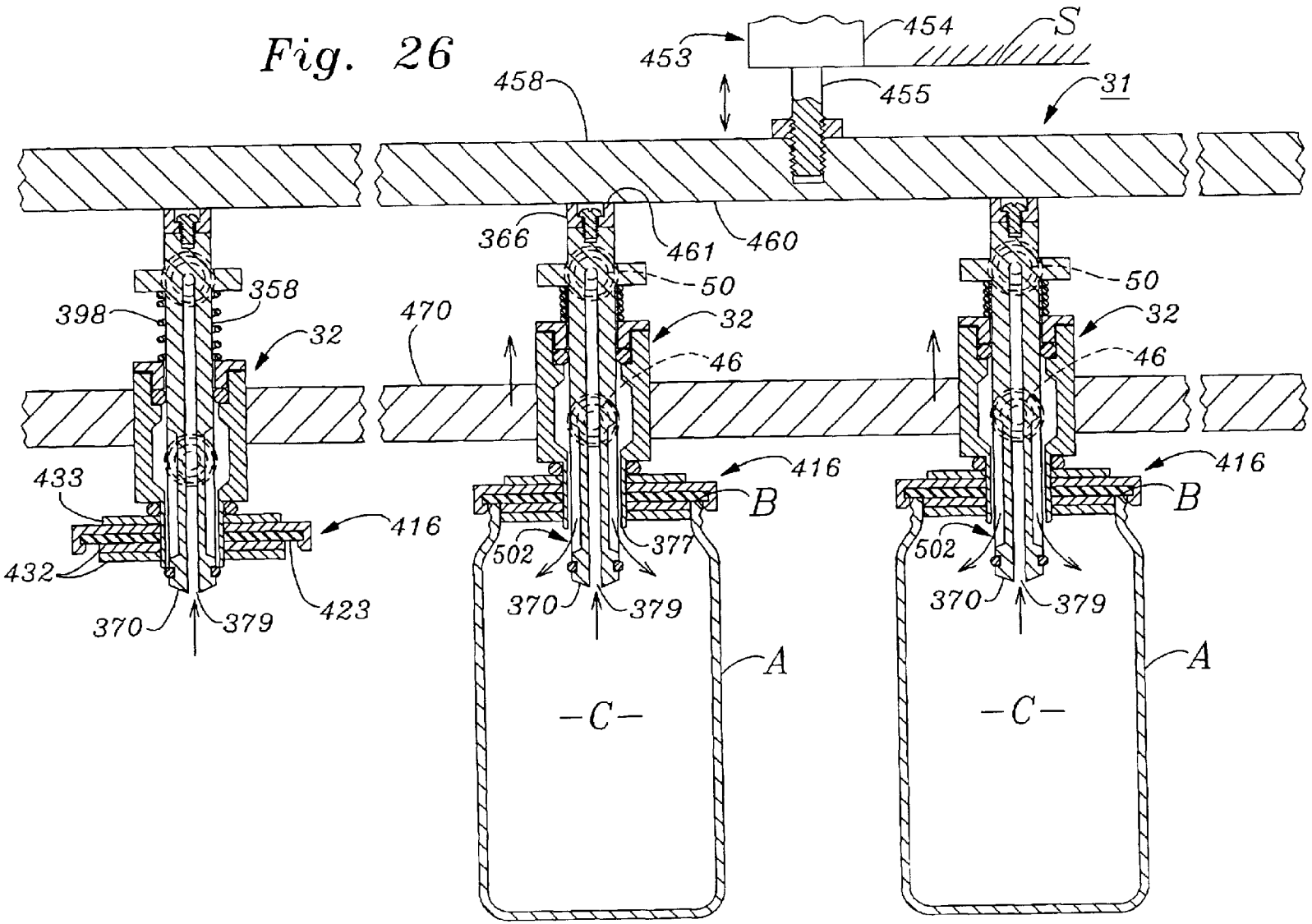
FIG. 26 is a fragmentary vertical medial sectional view of the filling machine of FIG. 1, taken along line 26—26.

As shown in FIGS. 1A–1E and 27, filling machine 31 and pumping machine 51 of liquid container filling apparatus 30 are interconnected by pressurized product supply hose 56 and a low pressure product return hose 68. This arrangement enables filling machine 31 and pumping machine 51 to be installed at physically spaced apart locations within the vicinity of a production line which utilizes apparatus 30. FIGS. 2–16 illustrate various aspects of pumping machine 51 of apparatus 30, FIGS. 17–24 show details of the novel pressure/vacuum fill heads 32 used in the apparatus, and FIGS. 25–27 illustrate various aspects of filling machine 31.

Turning now to FIGS. 2–8, pumping machine 51 of apparatus 30 may be seen to include double action piston pump 52, upper front and rear outlet check valves 53, 54, pump outlet manifold 55, product supply outlet hose 56, lower front and rear inlet check valves 57, 58, pump inlet manifold 59, product inlet hose 60, and pneumatic pump actuator cylinder 69 all of which were discussed above.

As may be seen best by referring to FIGS. 2–8, double action piston pump 52 includes an elongated hollow circular cylinder 70 which is closed at a front transverse end thereof by a circular bulkhead or head plate 71. Head plate 71 is removably secured to pump cylinder 70 by a toggle clamp 72 which has upper and lower semi-circularly shaped, half-ring segments 73, 74 that have radially inwardly protruding, front and rear semi-annular flanges 75, 76 which engage annular ring-shaped grooves 77, 78 in the outer cylindrical wall surfaces of head plate 71 and cylinder 70, respectively, the two halves of the clamp being secured together by a threaded toggle bolt 79. Toggle bolt 79 has a threaded stud 79A pivotably secured within a slot 79B in upper ring segment 73. Semi-circular half-ring segments 73, 74 are joined by a pivot pin 73A which enables them to be pivoted together to form a closed circular ring, whereupon stud 79A is pivoted into a slot 79B formed in a lower edge of lower semi-circular half-ring 74, and a thumb nut 79C on the end of the threaded stud tightened down on the reverse surface of the lower semi-circular half-ring segment, thus securing it to upper semi-circular half-ring segment 73. Similarly, a rear transverse end of piston pump cylinder 70 is closed by circular base plate 80 which is removably secured to the cylinder by a toggle clamp 82 that has upper and lower semi-circular half-ring segments 83, 84 that have radially inwardly protruding front and rear semi-annular flanges 85, 86 which engage ring-shaped grooves 87, 88 in the outer cylindrical wall surfaces of cylinder 70 and base plate 81, the two halves of the clamp being secured together by a threaded toggle bolt 82.

Figure 8:
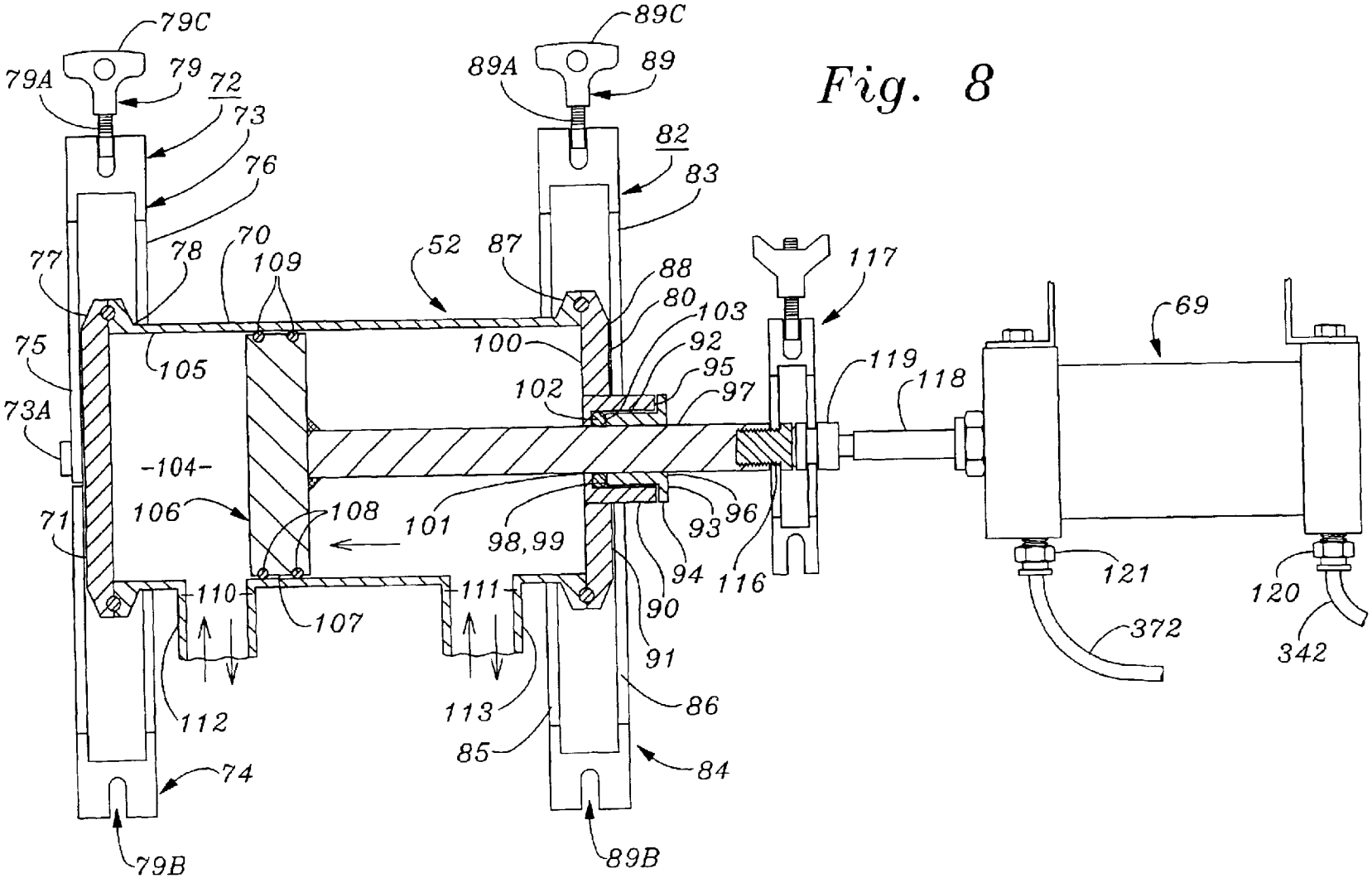
FIG. 8 is a partly sectional view of the apparatus of FIG. 2, taken in the direction of line 8—8.
Figure 9A:
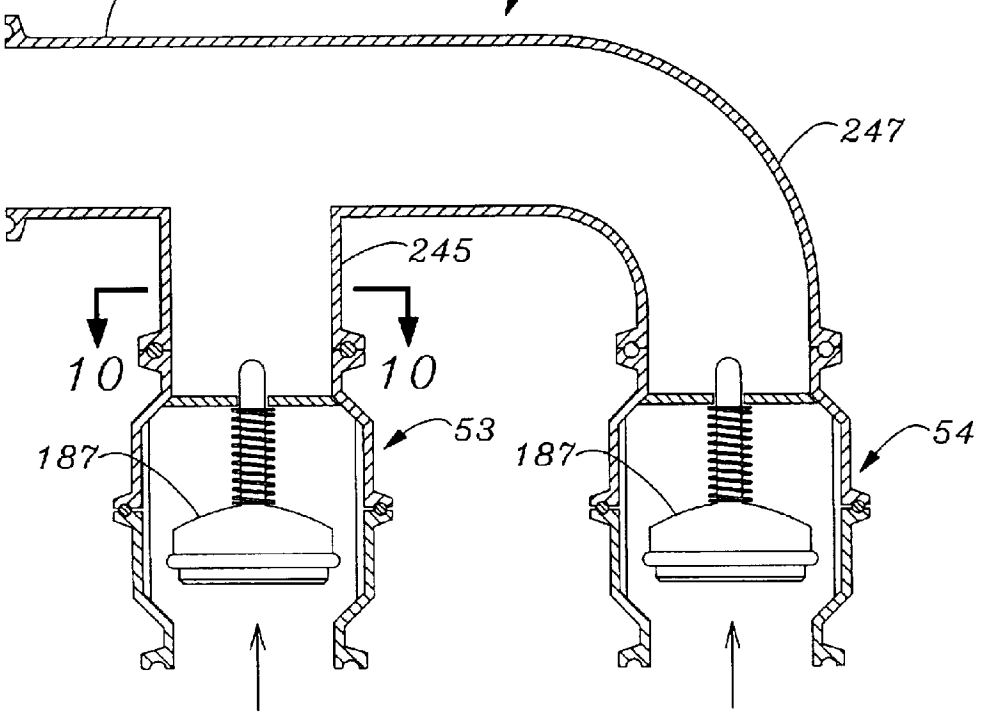
FIG. 9A is another vertical sectional view of the apparatus of FIG. 2, taken in the direction of line 9A—9A.
Figure 9B:
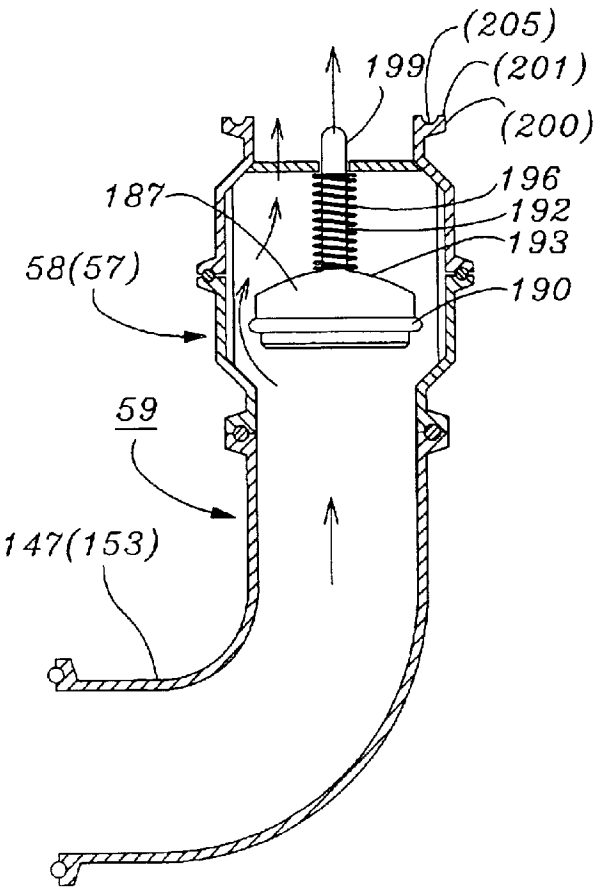
FIG. 9B is another vertical sectional view of the apparatus of FIG. 2, taken in the direction of line 9B—9B.
Figure 11:
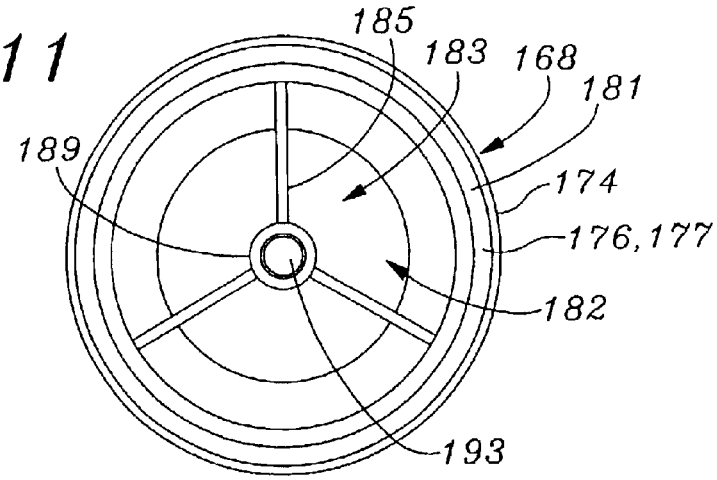
FIG. 11 is a lower plan view of an upper insert of the valve of FIG. 10.

As shown in FIG. 8, circular base plate 81 has a concentric cylindrical cup-shaped boss section 90 which protrudes rearward from rear face 91 of the base plate. Boss 90 has a rear bore 92 which receives in an interference fit a bushing 93 that has a rear annular flange 94 which seats against a rear annular surface 95 of the boss, the bushing having a longitudinally disposed bore 96 which longitudinally slidably receives a pump piston rod 97. Boss 90 also has at a front longitudinal end thereof an annular flange wall 98 which has a front surface 99 coextensive with the front inner wall surface 100 of base plate 80. Flange wall 98 has through its thickness a longitudinally disposed coaxial bore 101 which slidably receives piston rod 97. An O-ring 102 fitted between front or inner transverse annular end wall 103 of bushing 93, and flange wall 98, forms a fluid pressure-tight seal with the outer cylindrical wall surface 104 of piston rod 97.

As may be seen best by referring to FIG. 8, cylinder 70 of pump 52 has a longitudinally disposed cylindrical bore 104 defined inside an inner cylindrical bore wall surface 105 of the cylinder. Bore 104 of cylinder 70 longitudinally slidably holds a circular disk-shaped piston 106 attached to a front or inner end of piston rod 97. Piston 106 has formed in an outer cylindrical wall surface 107 thereof at least one radially inwardly protruding annular ring-shaped groove 108 which holds an O-ring type piston ring 109 that makes a fluid pressure-tight seal with cylinder bore wall surface 105.

Figure 3:
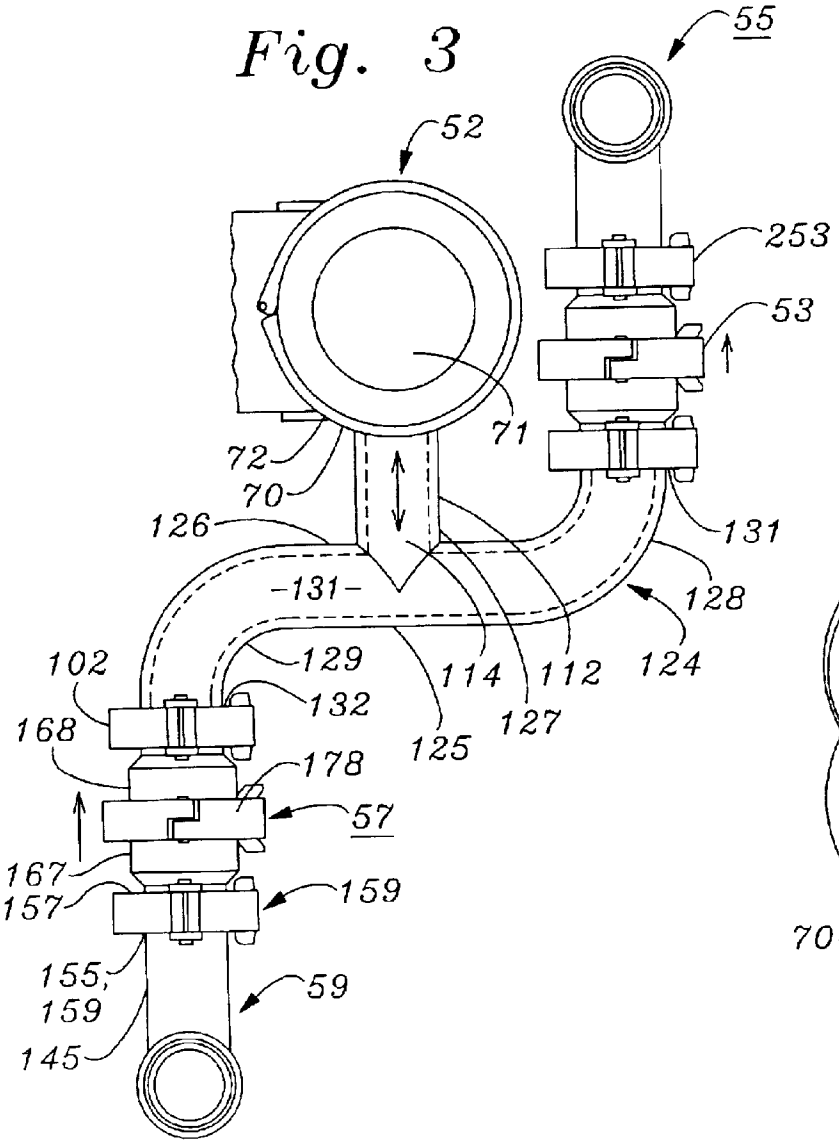
FIG. 3 is a left side elevation view of the apparatus of FIG. 2.
Figure 6:
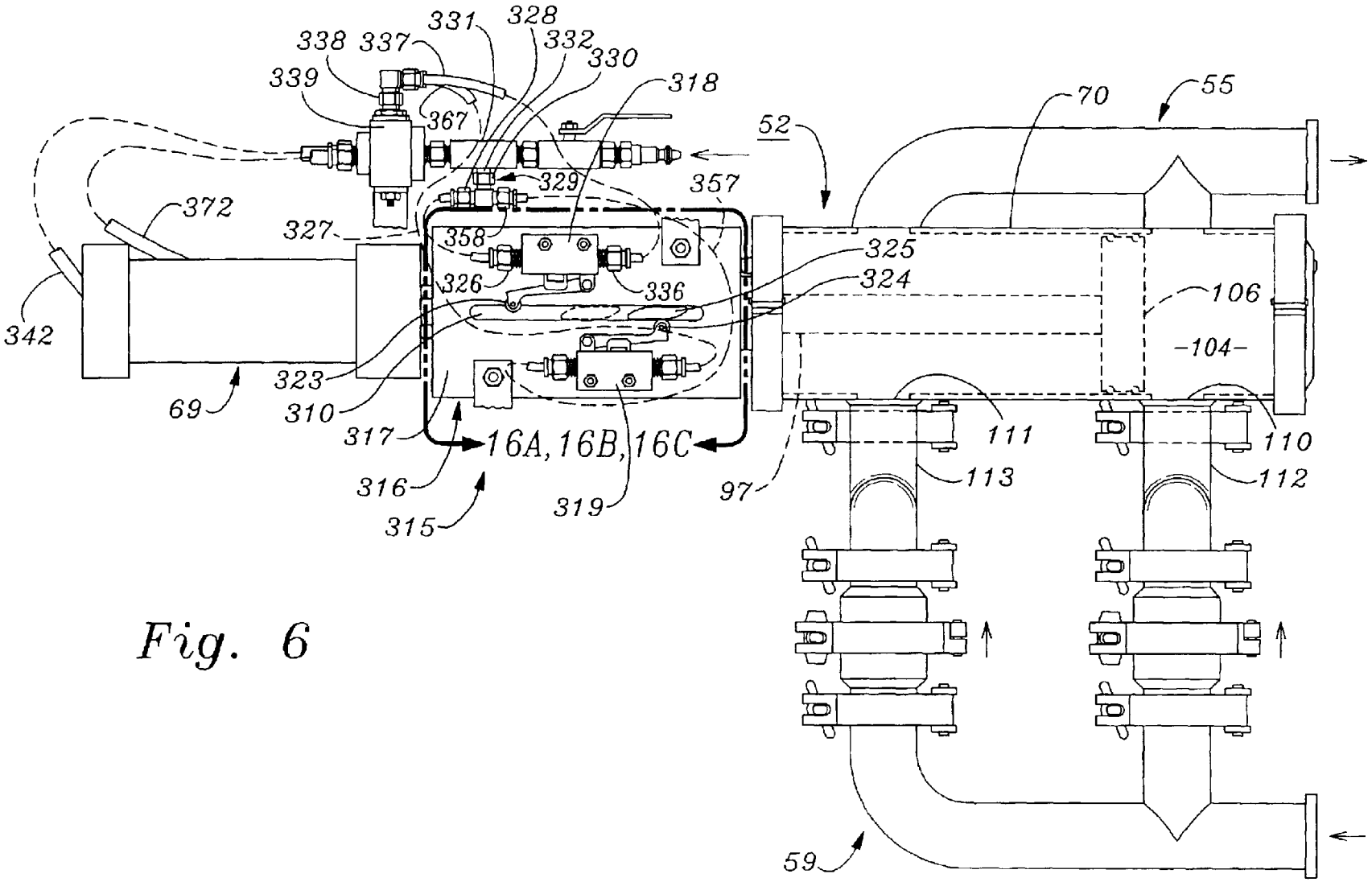
FIG. 6 is a rear elevation view of the apparatus of FIG. 2.

Referring still to FIGS. 3, 6, and 8, it may be seen that cylinder 70 of piston pump 52 has through a lower cylindrical wall surface thereof a pair of front and rear circular port holes 110, 111, respectively, which are located in front of and behind the maximum front and rear travel of piston 106 within cylinder bore 104. Front and rear ports 110, 111 have protruding downwardly therefrom front and rear port tubes 112, 113, respectively, which have bores 114, 115 which communicate sealingly with cylindrical piston bore 104 of cylinder 70. The function of ports 110, 111 will be described below.

Figure 7:
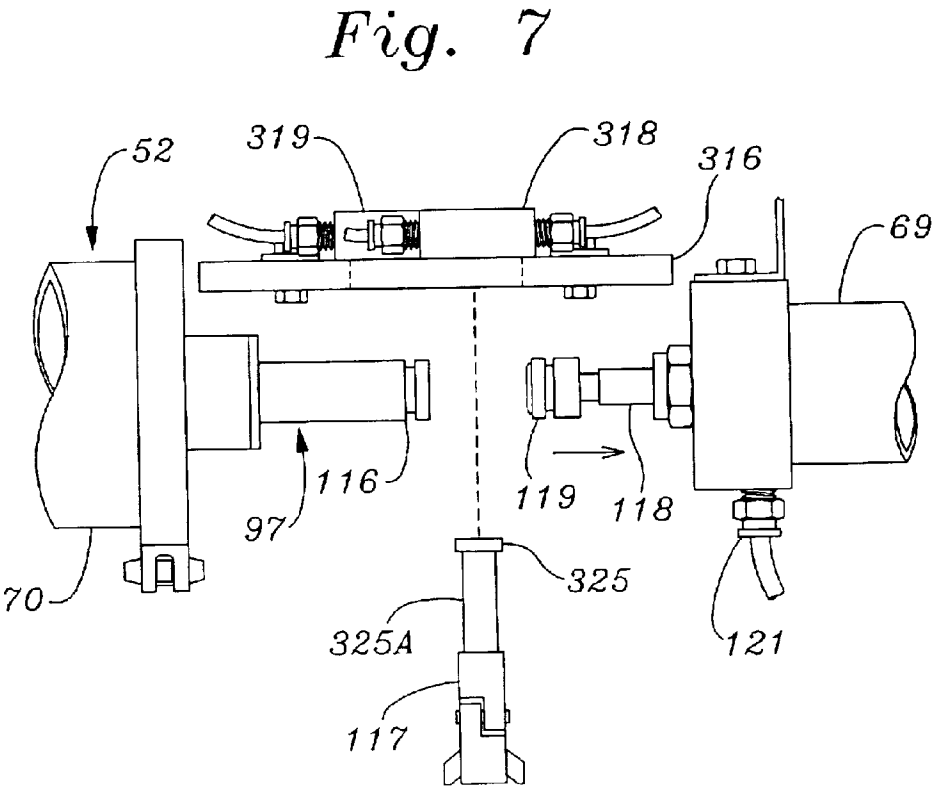
FIG. 7 is a fragmentary, partly exploded, upper view of the apparatus of FIG. 4, on an enlarged scale.
Figure 5:
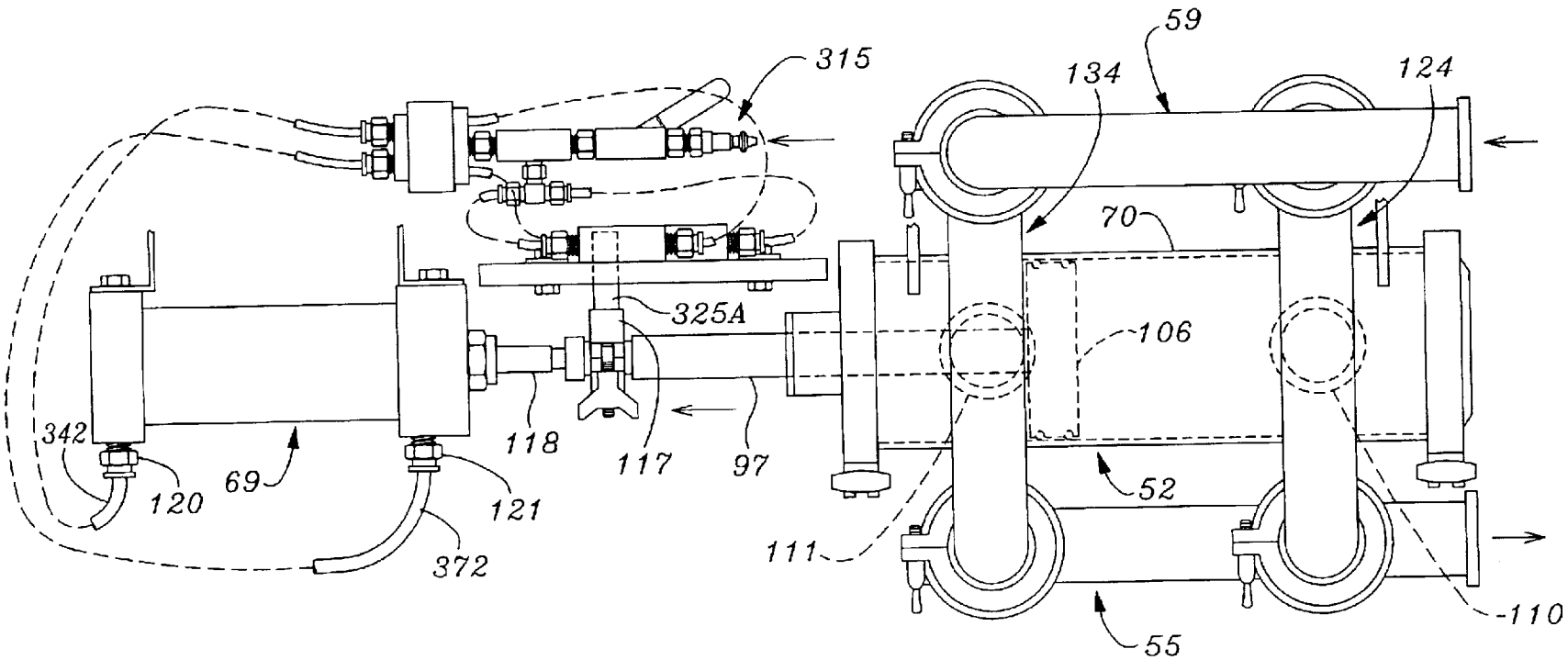
FIG. 5 is a lower plan view of the apparatus of FIG. 2.

Referring to FIGS. 2, 7, and 8, it may be seen that rear end portion 116 of pump piston rod 97 is axially aligned with and coupled by a toggle clamp 117 to the front end portion 119 of an actuator piston rod 118 which protrudes forward from pneumatic actuator cylinder 69. Toggle clamp 117 is structurally and functionally substantially similar to toggle clamps 79, 89 described above, but smaller. Pneumatic actuator cylinder 69 is a double action type, in which actuator piston rod 118 is forcibly extended when a rear port 120 of the actuator cylinder is supplied with pressurized air, and is forcibly retracted when a front port 121 of the actuator cylinder is supplied with pressurized air. Thus, when rear port 120 of actuator cylinder 69 is energized, piston 106 is pushed forward in bore 104 of pump cylinder 70 to a position in which front surface 122 of the piston is located just rearward of front pump port 110, as shown in FIG. 6. Similarly, when front port 121 of pneumatic actuator cylinder 69 is supplied with pressurized air, piston 106 is pulled rearward in bore 109 of pump cylinder 70 to a position in which rear surface 123 of the piston is located just forward of rear pump port 111, as shown in FIG. 5. This reciprocating action of piston 106 within pump cylinder 70 is effective in cyclically drawing in and expelling liquid food product through ports 110, 111 of pump 52, in a manner which is described below.

Referring now to FIGS. 2, 3, 5 and 8, when piston 106 is withdrawn rearwardly within bore 104 of pump cylinder 70, liquid food product is drawn from inlet manifold 59 upward through front inlet check valve 57 and through front cylinder port 110 into that portion of cylinder bore 104 forward of the piston, and liquid food product within cylinder bore rearward of the piston is forced outwards through rear cylinder port 111 of the pump, through rear outlet check valve 54 and into outlet manifold 55. Conversely, when piston 106 is pushed forward within pump cylinder 70, liquid food product is drawn upwards from inlet manifold 59 through rear inlet check valve 58 and through rear pump cylinder port 111 into cylinder bore 104 rearward of the piston, and liquid food product within the cylinder bore forward of the piston is forced outwards through front cylinder port 110 of the pump, through front outlet check valve 74 and into outlet manifold 55. Location of inlet/outlet ports 110, 111 at the lowest elevation of cylinder 70 insures that liquid food product is advanced through pump 52 without any retention of liquid food product within cylinder 70 for a period longer than one pump piston cycle, thereby ensuring that only fresh liquid food product is output from outlet manifold 55 to fill heads 32. Moreover, location of ports 110 and 111 at the lowest part of cylinder 70 enables all material to be completely drained out of cylinder 70 when the pump fittings are disconnected for cleaning.

As may be seen best by referring to FIGS. 2, 3, and 6, pump 52 of pumping machine 51 includes a front port distribution or cross tube 124 which has a fore-and-aft disposed, horizontal section 125 that has an upper outer cylindrical surface 126 which forms a T-intersection with a lower end portion 127 of vertically downwardly protruding front port tube 112. Front port distribution tube 124 also has an upwardly curving fore leg 128, and a downwardly curving aft leg 129. The front distribution tube 124 preferably has a circular cross-sectional shape end, and has disposed through its length a hollow circular bore 130 which communicates with bore 114 of front port tube 112. Also, fore-and-aft legs 128, 129 of front cross tube 124 have at the upper and lower ends thereof, respectively, transversely disposed, radially outwardly protruding connector flanges 131, 132, respectively.

Pump 52 also includes a rear port distribution or cross tube 134 which has a fore-and-aft disposed, horizontal section 135 that has an upper cylindrical surface which forms a T-intersection with a lower end portion 137 of vertically downwardly protruding rear port tube 113. Rear port distribution tube 134 also has an upwardly curving fore leg 138, and a downwardly curving aft leg 139. The rear distribution tube 134 preferably has a hollow circular cross-sectional shape, and has disposed through its length a hollow circular bore 140 which communicates with bore 115 of rear port tube 113. Also, fore-and-aft legs 138, 139 of rear cross tube 134 have at the upper and lower ends thereof, respectively, transversely disposed, radially outwardly protruding connector flanges 141,142, respectively.

Referring now primarily to FIGS. 2 and 3, it may be seen that product inlet manifold 59 includes a straight, horizontally disposed inlet tube section 144, a front straight vertical intermediate runner tube 145 which extends perpendicularly upwards from an upper cylindrical surface 146 of the straight inlet tube section, and a rear vertically upwardly curved end runner tube 147. Inlet tube section 144 of inlet manifold 59 has through its length a bore 148 that has and inlet port opening 149 circumscribed by a radially outwardly protruding inlet connector flange 150. Bore 148 extends through the length of rear end runner tube 147, which has a rear outlet port opening 151 circumscribed by a radially outwardly protruding rear outlet connector flange 152. Also, front vertical runner tube 145 of inlet manifold 59 has through its length a bore 153 that communicates with bore 148 and which has an outlet opening 154 circumscribed by a radially outwardly protruding front outlet connector flange 155.

As may be seen best by referring to FIGS. 2, 3, and 6, outlet flanges 155, 152 of front and rear inlet manifold runner tubes 145, 147 are coupled to inlet connector flanges 157, 158 of front and rear inlet check valves 57, 58 by lower toggle clamps 159, 160, of the type described above. As will be described in greater detail below, inlet check valves 57, 58 are identical in construction and function to each other and to outlet check valves 53, 54.

As shown in FIGS. 10–13, each check valve 53, 54, 57, 58 comprises a valve 161 having a lower, inlet opening 162 circumscribed by an inlet connector flange 163, a hollow cylindrical housing 164, and an upper outlet opening 165 circumscribed by an outlet connector flange 166. As may be seen best by referring to FIG. 10, housing 164 of valve 161 is comprised of a hollow, generally cylindrically-shaped, lower, inlet half 167 and a similarly shaped upper, outlet half 168. Lower, inlet half 167 of valve housing 164 has an upper circular joint opening 169 circumscribed by an upper joint flange 170. Similarly, upper, outlet half 168 of valve housing 164 has a lower circular joint opening 171 circumscribed by a lower joint flange 172. Lower and upper mating joint flanges 170, 172 of lower and upper valve housing body halves 167, 168 have formed in flat outer transverse faces 173, 174 thereof annular grooves 175, 176 adapted to receive in compressive fit a seating O-ring 177. Valve body halves 167 and 168 are secured together in a readily disassembleable and re-assembleable manner by a toggle clamp 178 of the type described above.

Referring still to FIGS. 10–13, it may be seen that lower valve housing half 167 contains an annular ring-shaped valve seat insert 179 which has an upwardly concave annular ring-shaped valve seat 180. Upper valve housing half 168 contains an annular ring-shaped valve stem support insert 181. Valve stem support insert 181 has attached within a lower circular opening 182 thereof a valve stem support spider 183 comprised of a concentric circular bushing 184 coaxially supported within opening 182 by at least three and preferably four circumferentially spaced apart radially disposed arms 185.

Referring to FIG. 10, it may be seen that housing 164 of valve 161 contains therewithin a valve body 186 which includes a lower circular disk-shaped sealing body 187 that has a frusto-conically-shaped lower portion 188 which has in an outer longitudinal surface thereof and an annular ring-shaped groove 189 that holds an O-ring 190. Lower portion 188 of sealing body 187 has a flat, transversely disposed lower surface 191. Valve body 186 also has an elongated cylindrically-shaped stem 192 which protrudes perpendicularly upwards from upper surface 193 of disk-shaped sealing body 187 and is concentric therewith. The upper end portion 199 of stem 192 is longitudinally or axially slidably held within a central coaxial bore 195 of valve stem support spider bushing 184.

As shown in FIG. 10, an elongated helical compression spring 196 fits coaxially over valve stem 192; the spring has an upper end 197 which bears against lower surface 198 of bushing 184, and a lower end 199 which bears against upper surface 193 of valve sealing body 187. Thus arranged, spring 196 biases valve 53 to a closed position, in which a fluid pressure-tight seal is made between valve body O-ring 190 and valve seat 180 in lower valve housing half 167. Differential hydrostatic pressure between inlet opening 162 and outlet opening 165 of valve 161 that exceeds the force exerted on valve body 186 by spring 196 causes the valve body to move upwardly against the extension force exerted by the spring, allowing pressurized fluid to travel through the valve housing in the direction indicated by the arrow in FIG. 9B. Conversely, hydrostatic pressure on upper surface 193 of valve body 187 produces a valve closing force in the same direction as that exerted by spring 196, preventing fluid flow in the opposite direction through the valve, for pressures up to the maximum design pressure of the valve.

As shown in FIGS. 2, 3, 9B and 10, each check valve such as inlet check valve 57 which is in-line or series with aft leg 129 of front port distribution or cross tube 124, has in the upper portion thereof an outlet connector flange 200 which has an annular upper face 201 that mates with lower annular face 202 of aft leg flange 129, and is clamped into sealing contact therewith by a toggle clamp 203. Preferably, lower face 202 of aft leg flange 129 and upper face 201 of inlet check valve 57 have formed therein vertically aligned, equal size annular grooves 204, 205 which cooperatively hold a sealing O-ring 206.

In a construction exactly similar to that described in the previous paragraph, downwardly turning aft leg 139 of rear port distribution or cross tube 134 is coupled to the upper, outlet end of inlet check valve 58 by a toggle clamp 213.

Referring now primarily to FIGS. 2, 3, 9A, and 14, it may be seen that product outlet manifold 55 has a construction which is substantially mirror symmetric through a horizontal medial mirror plane with inlet manifold 55, i.e., has the same geometrical construction as that of an inverted inlet manifold. Thus, outlet manifold 55 has a straight, horizontally disposed outlet tube 244, and front and rear downwardly protruding straight and curved runner tubes 245, 247, respectively. The latter are coupled to outlet ports of outlet check valves 53, 54 by front and rear toggle clamps 253, 254, respectively. Also, the inlet ports of front and rear outlet check valves 53, 54 are coupled to fore leg 128 of front cross tube 124, and fore leg 138 of rear cross tube 134, respectively, by toggle clamps 303 and 313, respectively.

Pumping machine 51 includes mechanism components which cause piston 106 to oscillate longitudinally, i.e., reciprocate within pump cylinder 70, as will now be described.

As shown in FIGS. 2, 4, 5, and 6, pumping machine 51 includes a valve controller mechanism which in conjunction with a source of pressurized air, pneumatic actuator cylinder 69, and double action piston pump 52 functions as a pneumatic analog of an astable multi-vibrator, causing piston 106 of the pump to oscillate longitudinally within pump cylinder 70. As shown in the Figures, valve controller mechanism 315 includes a vertically disposed pilot valve support plate 316 having a rear surface 317 on which is mounted upper and lower pressure pilot valves, 318, 319. Upper and lower pilot valves 318, 319 are located on upper and lower sides, respectively, of a horizontally disposed and elongated, rectangular perforation 320 provided through the thickness dimension of pilot valve support plate 316. Pilot valves 318, 319 have pivotable input control levers 321, 322, terminated by rollers 323, 324, respectively, which protrude vertically below the upper edge 320U and above the lower edge 320L, respectively, of perforation 320.

As may be seen best by referring to FIGS. 2, 4, 5, 6, 15, and 16, toggle clamp 117 which couples together pump piston rod 97 and pneumatic actuator cylinder piston rod 118 has protruding rearwardly therefrom an arm 325A having at the rear end thereof a rhomboidal cross section cam 325 which protrudes through perforation 320. As shown in FIG. 6, upper pilot valve 318 has an air inlet port 326 connected by a hose 327 to a first outlet port 328 of a pressure reducing Tee 329 that has an inlet port 330 connected to a side port 332 of a coupler 331. Coupler 331 has an inlet port 333 connected through an in-line on/off manual control valve 334 which in turn has an inlet port 335 connected to a source of pressurized "shop" air (not shown). Upper pilot valve 318 also has an outlet port 336 which is connected by a hose 337 to a low pressure control input port 338 of a first high pressure valve 339. The latter has an input port 340 connected to a source of high pressure air through coupler 331, and an outlet port 341 connected by a hose 342 to rear, extension force port 120 of pneumatic actuator cylinder 69.

In an exactly similar construction, lower pilot valve 319 has an air inlet port 356 connected by a hose 357 to a second outlet port 358 of pressure reducer T 329, and an outlet port 366 which is connected by a hose 367 to a low pressure control input port 368 of a second high pressure valve 369. The latter has an input port 370 connected to a high pressure air source through coupler 331, and an outlet port 371 connected by a hose 372 to front, retraction force port 121 of pneumatic actuator cylinder 69.

High pressure valves 339, 369 are mutually interconnected in a bistable, flip-flop configuration, such that either valve is always in a fully on or off state, and the other valve is always in the opposite state.

Figure 4:
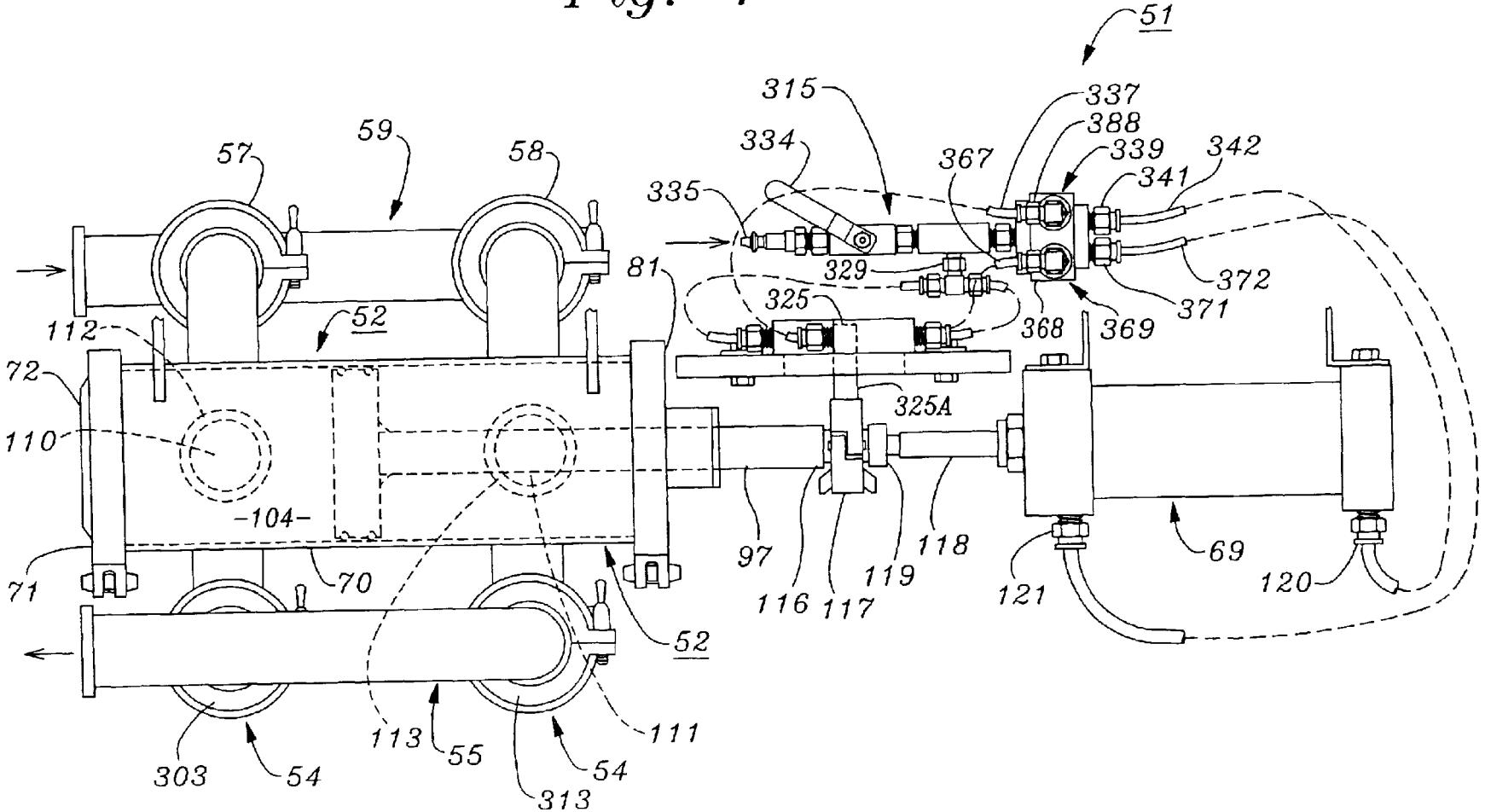
FIG. 4 is an upper plan view of the apparatus of FIG. 2.

Functional operation of valve control mechanism 315 may be best understood by referring to FIGS. 2, 4, 15, and 16. First, observe that pump piston 106 is located at an intermediate longitudinal position in cylinder 70, between front and rear travel limits as shown in FIG. 4. Thus positioned, pump piston rod 97 and pneumatic actuator cylinder rod 118 are also positioned intermediate between their front and rear travel limits, as shown in FIG. 15A. Now assume that pressurized air is applied to valve control mechanism 315. Since high pressure control valves 339, 369 which are in series with a pressurized air source and retraction and extension ports 121, 120, respectively of pneumatic activator cylinder 69, are configured as a bistable valve pair, either one or the other of the two valves will be in fully open state, allowing pressurized air to be applied to either retraction port 121 or extension port 120 of pneumatic cylinder 69.

Figure 15A:
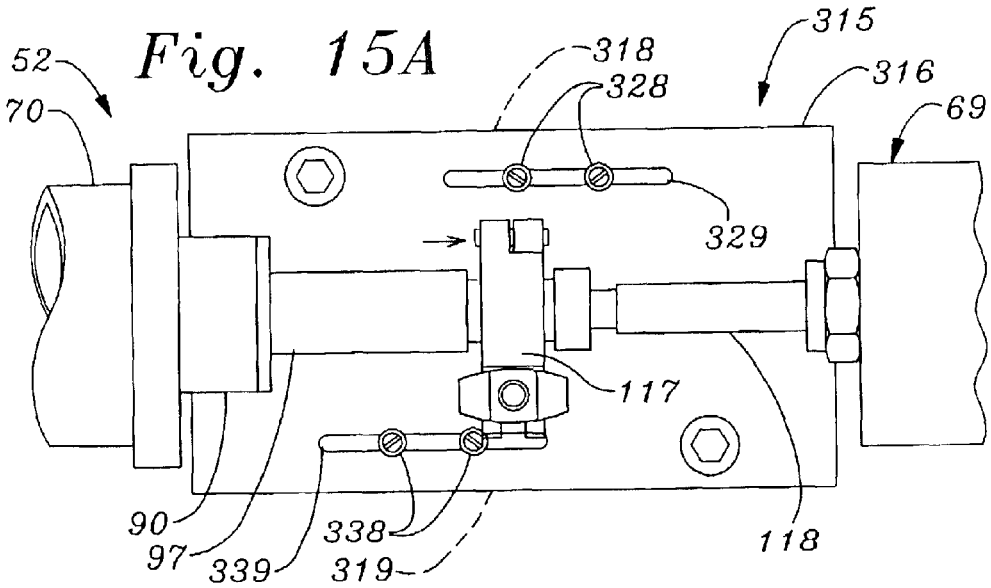
FIG. 15A shows a pump actuator piston rod at the center of its travel limits.
Figure 15B:
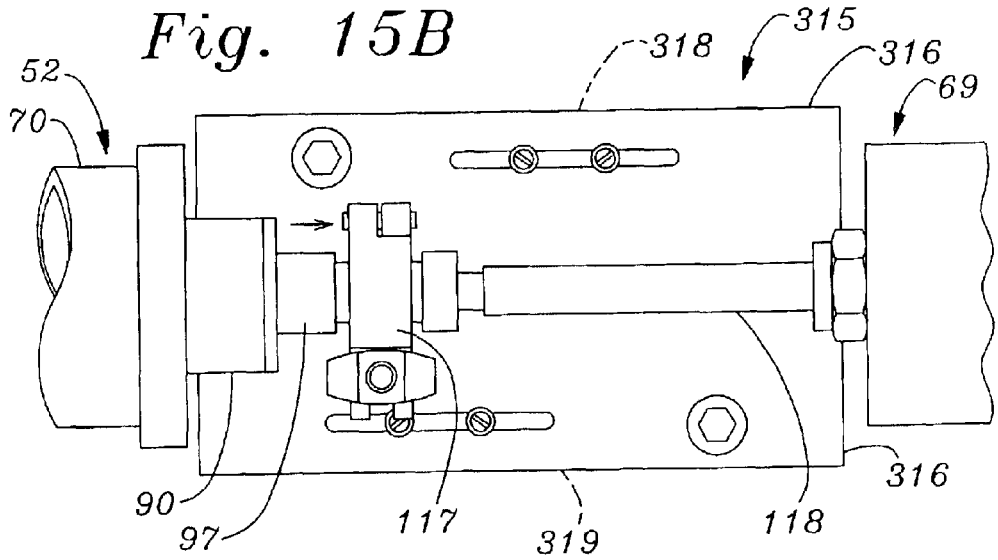
FIG. 15B shows the actuator piston rod at its maximum extension from the actuator cylinder.
Figure 15C:
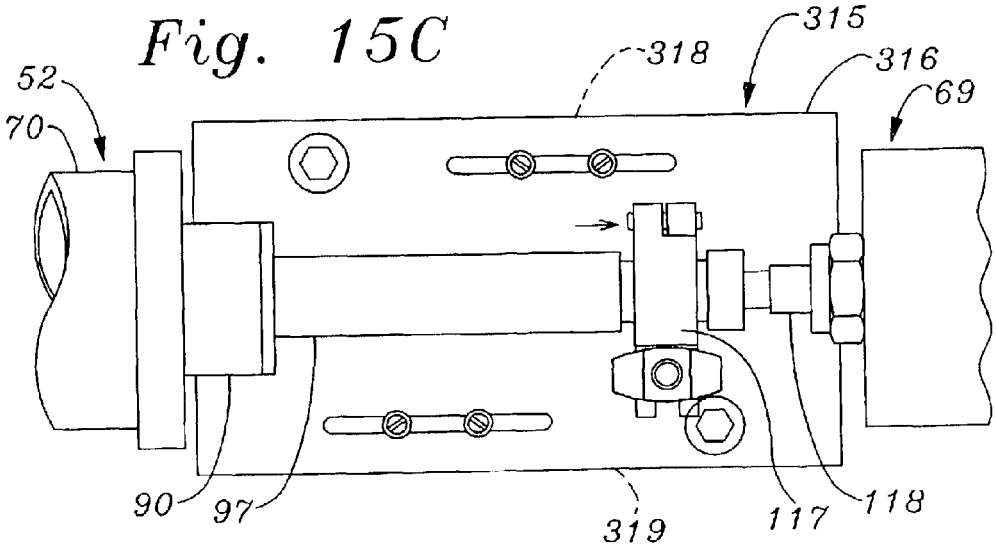
FIG. 15C shows the actuator piston rod at its minimum extension.
Figure 16A:
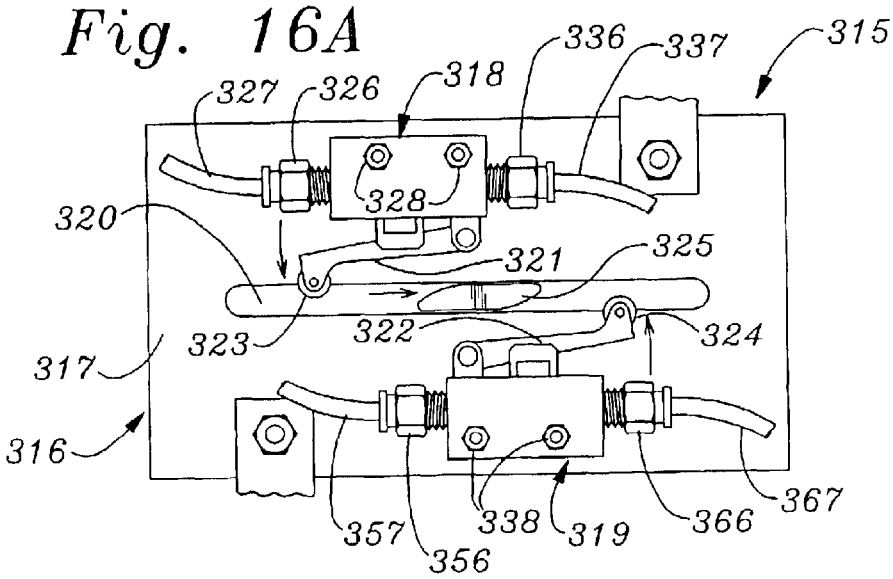
FIG. 16A shows the position of a valve actuator cam attached to a pump actuator piston rod with the rod at the center of its travel limits.
Figure 16B:
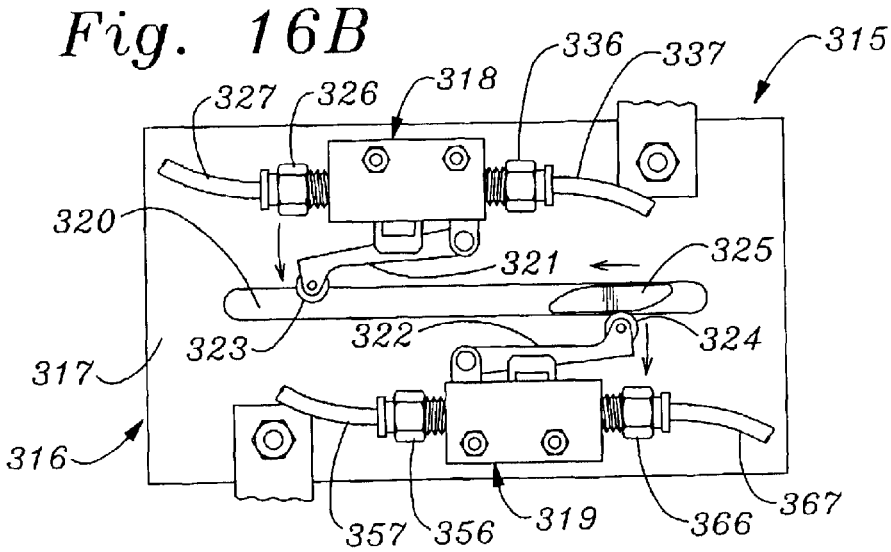
FIG. 16B shows the valve actuator cam with the actuator piston rod at its maximum extension; and 15C shows the valve actuator cam with the actuator piston rod at its minium extension.
Figure 16C:
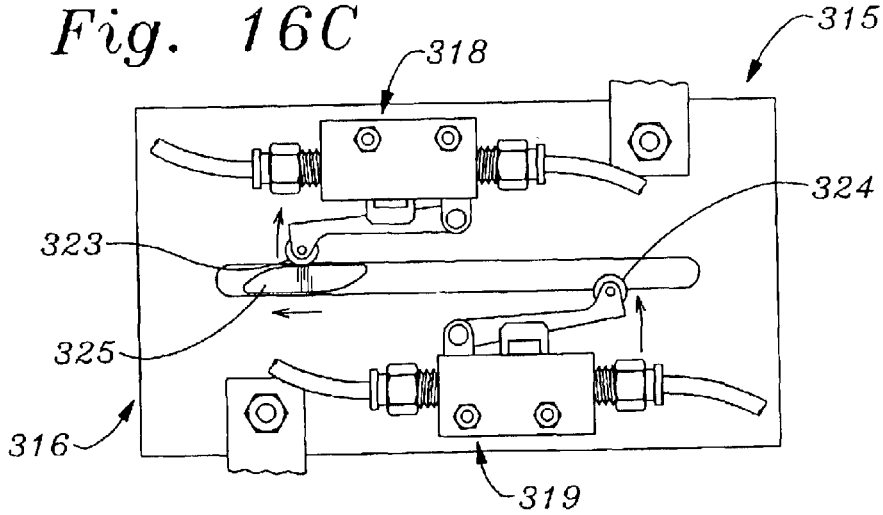

Without loss of generality, it may be assumed that when pressurized air is first applied to valve controller mechanism 315, valve 339 is initially in a fully open ON state, thus causing pressurized air to be applied to extension port 120 of pneumatic cylinder 69. This causes actuator piston rod 118 to extend to its forward limit, as shown in FIG. 15B, and valve actuator arm 325A and cam 325 to be translated to their maximum forward positions, as shown in FIG. 16B. At this position, contact of cam 325 with roller 324 of lower pilot valve 319 causes the lower pilot valve to open, thus causing low pressure pressurized air to be conducted through the lower pilot valve to control input port 368 of high pressure retraction control valve 369; this causes valve 369 to open and thereby conduct high pressure air to front, retraction port 121 of pneumatic actuator cylinder 69. Pressurization of front, retraction port 121 of pneumatic actuator cylinder 69 causes pneumatic actuator cylinder piston rod 1 18 to retract to its maximum inner, rearmost position, as shown in FIG. 15C, thus causing arm 325A and cam 325 to be translated to their maximum rearward positions, as shown in FIG. 16C. At this position, contact of cam 325 with roller 323 of upper pilot valve 318 causes the upper pilot valve to open, thus causing low pressure air to be conducted through the upper pilot valve to control input port 338 of high pressure extension control valve 339, thus causing valve 339 to open and thereby conduct high pressure air to rear, extension port 120 of pneumatic actuator cylinder 69. Pressurization of rear, extension port 120 of pneumatic actuator cylinder 69 causes pneumatic actuator cylinder piston rod 118 to extend to its maximum outer, forward position, as shown in FIG. 15B, thus causing arm 325A and cam 325 to be translated to their forward travel limits, as shown in FIG. 16B. This action completes one cycle of oscillation of pump piston 106 within cylinder 70, which oscillations continue as long as pressurized air is applied to valve controller 315.

With no liquid food product within cylinder 70 of pump 52, the maximum oscillation frequency of piston 106 within cylinder 70 is limited by frictional forces between the cylinder wall and piston, by frictional forces between the piston and cylinder wall of pneumatic actuator cylinder 69, the total oscillating mass, including that of the pistons and piston rods, and the pressure of air supplied to the valve controller. A typical oscillation frequency found suitable for the present invention is about one cycle per second. With liquid product introduced into cylinder 70 of pump 52, the oscillation frequency decreases, but may be increased by increasing the pressure of air supplied to cylinder 69, to thereby increase the pumping rate.

As shown in FIG. 15, upper pilot valve 318 is longitudinally adjustably mounted to pilot valve support plate 316 by a pair of screws 328 which protrude rearward through a longitudinally elongated, rectangularly-shaped perforation 329 through the valve support plate. Moving upper pilot valve 318 forwards or rearwards after loosening screw 328 causes maximum rearward movement of piston 106 in pump cylinder 70 to be decreased or increased, respectively. Preferably, as shown in FIG. 15, lower pilot valve 319 is also longitudinally adjustably mounted to pilot valve support plate 316, by a pair of screws 338 which protrude rearward through a longitudinally elongated, rectangularly-shaped perforation 339 through the valve support plate. Moving lower pilot valve 319 forwards or rearwards relative to valve support plate 316 after loosening screws 338 causes maximum forward movement of piston 106 in pump cylinder 70 to be increased or decreased, respectively. Thus, by adjusting the longitudinal positions of pilot valves 318 and 319, the forward and rearward travel limits and oscillation amplitude of pump piston 106 within pump cylinder 70 may all be adjusted.

FIGS. 17–25 illustrate structural and functional aspects of a novel pressure/vacuum liquid product fill head 32 according to the present invention.

As shown in FIGS. 17–25, pressure/vacuum fill head 32 includes a generally cylindrically-shaped, vertically elongated valve housing 341. Housing 341 has a reduced diameter, lower neck section 342, and a longer, large diameter upper main body section 343, the two sections being joined by a flat, transversely disposed annular ring-shaped shoulder 344. Upper section 343 of valve housing 341 has an upper transverse wall surface 345 which has protruding perpendicularly inwards therefrom a bore 346 terminated at an inner, lower end thereof by a radially inwardly protruding, annular shoulder flange 347. Bore 346 has fitted therein a bushing 348 which has an upper annular ring-shaped flange section 348A that has a flat, annular ring-shaped lower surface 349 which seats on a similarly shaped surface 350 forming the upper transverse wall of housing 341. Bushing 348 has a lower annular ring-shaped transverse end surface 351 which seats on the upper surface 352 of an O-ring 353 which seats on upper annular surface 354 of shoulder flange 347.

Figure 21:
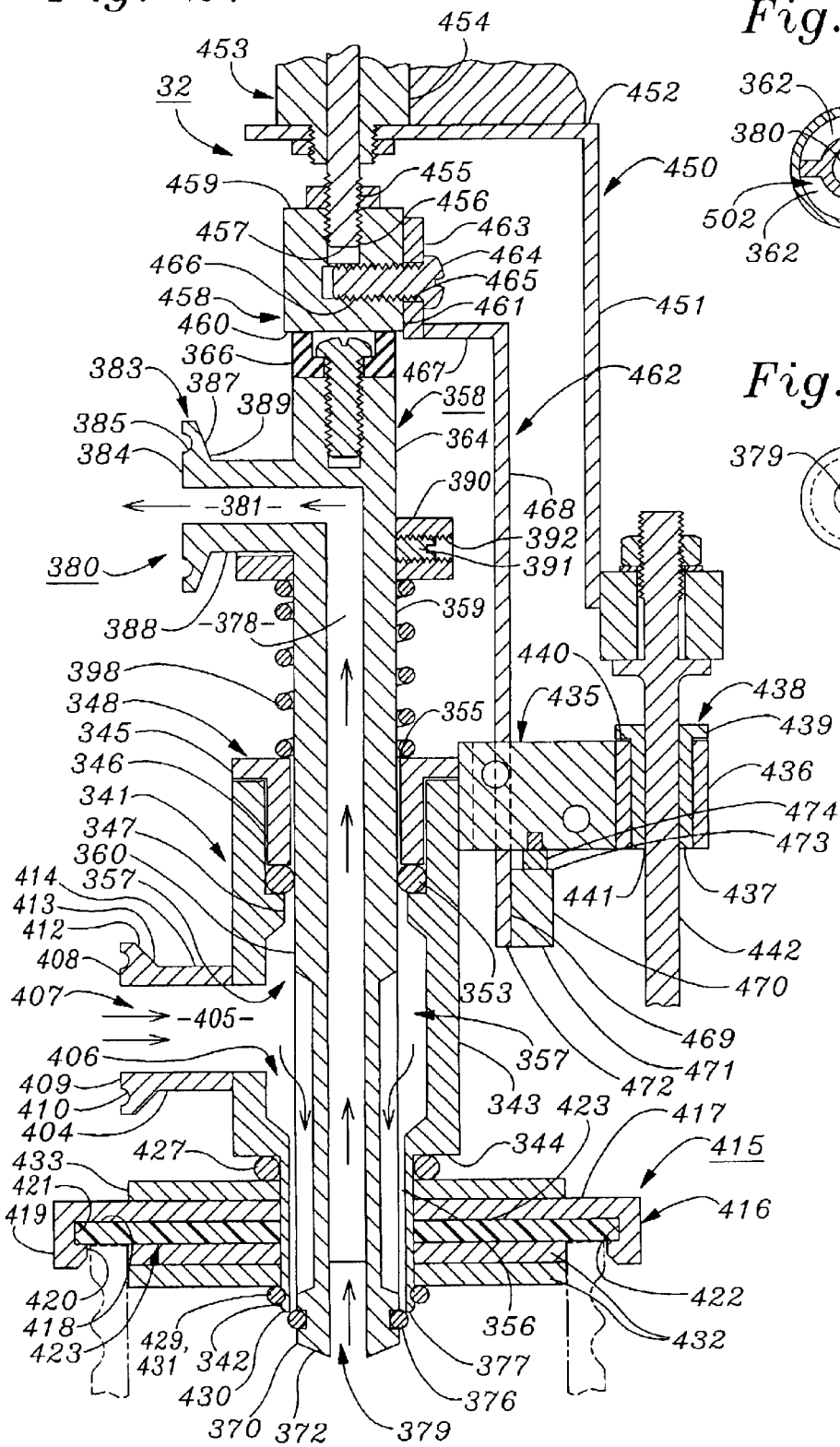
FIG. 21 is a vertical medial sectional view of the fill head of FIG. 17.

As may be seen best by referring to FIGS. 21 and 22, bushing 348 has therethrough a longitudinally disposed bore 355 which is coaxially aligned with a bore 356 of the same diameter through lower neck portion 342 of valve housing 341. Located in upper, larger diameter portion 343 of valve housing 341, between upper and lower coaxially aligned entrance bores 355, 356 is an enlarged inner diameter, elongated, generally cylindrically-shaped hollow space or plenum 357.

Figure 23:
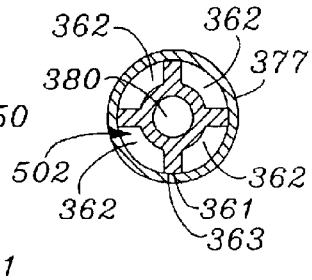
FIG. 23 is a transverse sectional view of the fill head of FIG. 22, taken along line 23—23.
Figure 24:
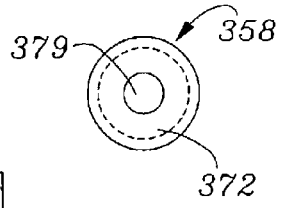
FIG. 24 is another transverse sectional view of the fill head of FIG. 22, taken along line 24—24.

Valve 32 includes a longitudinally elongated valve stem 358 which has a generally cylindrically-shaped intermediate portion 359 that is longitudinally slidably located within bore 355 of bushing 348. Valve stem 358 also has a lower portion 360 which is longitudinally slidably located within bore 356 through lower neck portion 342 of housing 341. Lower portion 360 of valve stem 358 has formed in the outer cylindrical wall surface 361 thereof a plurality of circumferentially spaced apart, longitudinally disposed, relatively deep grooves 362. As may be seen best by referring to FIG. 23, uncut portions of cylindrical valve stem surface 361 form longitudinally disposed ribs 363 which protrude radially outwards of grooves 362. Although the precise number of grooves 362 is not critical, an example embodiment of valve stem 358 which performed satisfactorily, had four grooves 362 separated by four rectangular transverse cross section ribs 363 spaced apart at ninety degree circumferential intervals to form a cruciform shape as shown in FIG. 23.

As shown in FIGS. 17–21, valve stem 358 has an upper generally cylindrically shaped section 364 which has attached to a transverse upper circular end face 365 thereof a cup-shaped bumper 366 made of relatively hard, but resilient material such as hard rubber. Bumper 366 is conveniently fastened to upper section 364 of valve stem 358 by a headed screw 367 which is inserted downwards through a central coaxial bore 368 in the bumper, and threaded into a blind threaded bore 369 which is coaxially located in upper end face 365 of the upper section of the valve stem.

As shown in FIGS. 21 and 22, valve stem 358 has at the lower end thereof a short, generally cylindrically-shaped boss section 370 having a radially inwardly angled upper annular wall surface 371 at which the lower longitudinal ends of grooves 362 terminate. Boss section 370 has a convex, generally frusto-conically-shaped lower end face 372, and a generally cylindrically-shaped intermediate portion 373 disposed between the lower end face and the upper annular face 371 of the boss section. Intermediate portion 373 of boss 370 has formed in the outer cylindrical surface 374 thereof an annular ring-shaped groove 375 which holds a resilient O-ring 376. As shown in FIG. 21, O-ring 376 seats sealingly against lower annular surface 377 of lower valve housing portion 342, when valve stem 358 is in an upper, closed position relative to valve housing 341.

As is also shown in FIGS. 21 and 22, valve stem 358 has disposed longitudinally through a substantial portion of its length a coaxially centrally located, hollow circular bore 378. Bore 378 has a lower entrance opening 379 which penetrates lower end face 372 of valve stem boss 370. Also, as shown in the figures, valve stem 358 has a radially disposed, hollow tubular-shaped neck 380 which protrudes perpendicularly outwards form upper cylindrical portion 364 of the valve stem, near upper end face 365 of the valve stem. Neck 380 has therethrough a hollow bore 381 which communicates at an inner radial end thereof with the upper end of central longitudinally disposed bore 378 through valve stem 358. Bore 381 through neck 380 has an outer entrance opening 382 centered in a radially outwardly protruding connector flange 383 located at the outer lateral end of the neck. Connector flange 383 has a flat, annular ring-shaped outer face 384 in which is coaxially located a circular groove 385 for holding a sealing O-ring 386. Also, connector flange 383 has a laterally inwardly located, frusto-conically-shaped surface 387 which joins outer cylindrical wall surface 388 of neck 380, and forms therewith a groove 389 for receiving a circular flange of a toggle clamp of the type described above.

As will be described later, neck 380 serves as a vacuum connection port which is connected to a vacuum source to thereby produce a vacuum in neck bore 381 and valve stem central bore 378.

Figure 17:
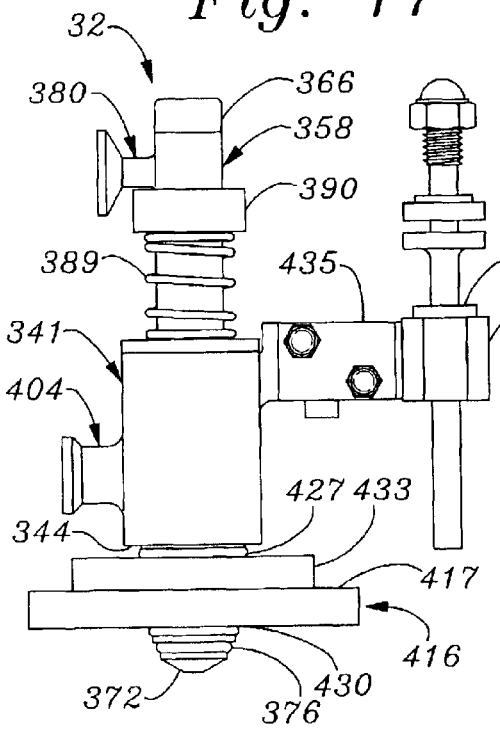
FIG. 17 is a front elevation view of a novel liquid product fill head comprising part of the machine of FIG. 1.
Figure 18:
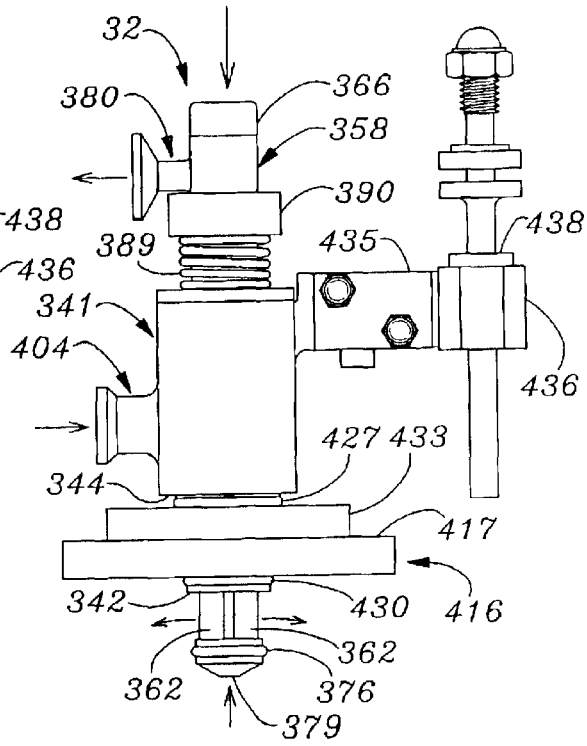
FIG. 18 is a view similar to that of FIG. 17, but showing a valve stem comprising part of the fill head moved downwards to an active filling disposition.
Figure 19:
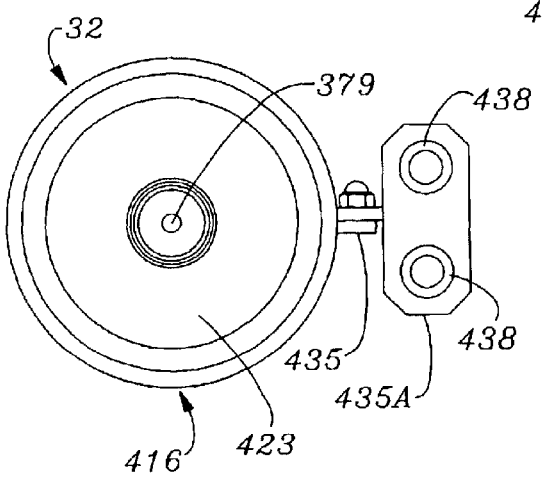
FIG. 19 is a lower plan view of the fill head of FIG. 17.
Figure 20:
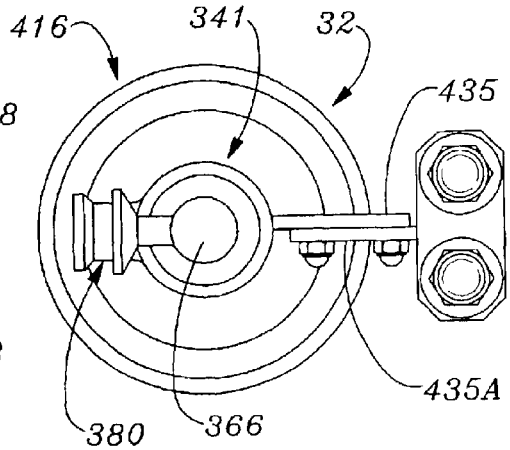
FIG. 20 is an upper plan view of the fill head of FIG. 17.
Figure 20A:
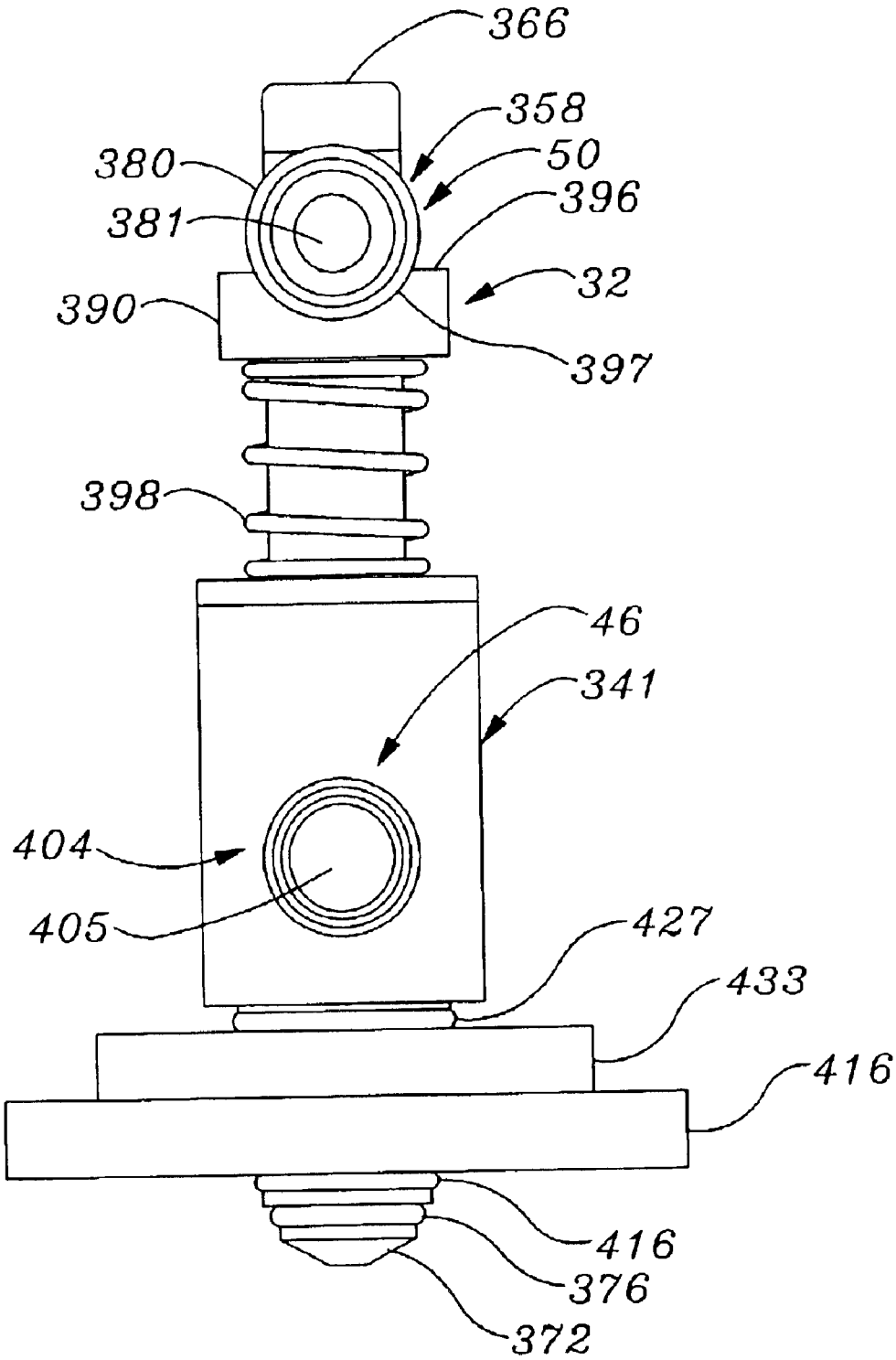
FIG. 20A is a left side elevation view of the fill head of FIG. 17.

As may be seen best by referring to FIGS. 17 and 21, pressure/vacuum fill head 32 includes a force adjusting collar 390 which fits coaxially over upper end portion 364 of valve stem 358, below neck 380. Collar 390 is secured to valve stem 358 at an adjustable height by a set screw 391 threaded into a bore 392 which protrudes radially inwards from an outer cylindrical wall surface 393 of the bushing, the screw being tightened so that is inner end 394 bears against outer surface 395 of the valve stem. As shown in FIG. 20A, collar 390 has formed in an upper flat surface 396 thereof a radially disposed groove 397 for receiving a lower portion of outer cylindrical wall surface 388 of neck 380.

Referring now primarily to FIGS. 17, 18, 21 and 22, it may be seen that pressure/vacuum fill head 32 includes a helical compression spring 398 which fits coaxially over upper portion 364 of valve stem 358, the spring having an upper coil 399 which exerts an upwardly directed extension force on lower surface 400 of bushing 390, and a lower coil 401 which exerts a downwardly directed extension force on upper surface 402 of valve guide bushing 348. With this construction, valve stem 358 is urged upwards within valve housing 341, causing O-ring 376 at the lower end of the valve stem to seat in fluid pressure-tight contact with lower annular surface 377 of the valve housing.

As may be seen best by referring to FIG. 21, valve housing 341 has located between the lower face 344 and upper face 345 thereof a radially outwardly protruding, tubular product inlet port 404. Product inlet port 404 has disposed through its length a bore 405 which has an inner exit opening 406 that communicates with the hollow interior space or plenum 357 within valve housing 341. Product inlet bore 404 also has an inlet opening 407 in a transversely disposed circular connector flange 408 located at the outer radial end of the product inlet port. Connector flange 408 has a flat, annular ring-shaped outer face 409 in which is formed a coaxial circular groove 410 for holding a sealing O-ring 411. Also, connector flange 408 has a laterally inwardly located, frusto-conically-shaped inner surface 412 which joins outer cylindrical wall surface 413 of product inlet port 404, and forms therewith a groove 414 for receiving a circular flange of a toggle clamp of the type described above.

Referring still to FIGS. 17–21, it may be seen that pressure/vacuum fill head 32 has attached coaxially over lower reduced diameter end 342 of valve housing 341 a circular cap or sealing assembly 415 which includes a seal holder body 416. As shown in FIGS. 17–21, seal holder body 416 has a circular shape with a flat upper surface 417 and a flat lower surface 418 which is circumscribed by a downwardly protruding, cylindrical flange wall 419 that has a radially inwardly protruding, annular ring-shaped, retainer flange 420. Retainer flange 420 has an upper annular ring-shaped surface 421 located below and parallel to lower surface 418 of seal holder body 416, and forms therewith an annular ring-shaped groove 422 which receives a circular disk-shaped sealing pad 423. Seal holder body 416 and sealing pad 423 have through their thickness dimension central circular perforations 424, 425, respectively, for receiving lower reduced diameter end 342 of valve housing 341. Sealing pad 423 is made of a resilient material such as silicone rubber, and has a flat lower surface 426 adapted to fit compressively against the rim B of a container A, as shown in FIGS. 21 and 22.

As shown in FIGS. 21 and 22, seal holder body 416 of sealing assembly 415 is preferably resiliently attached to valve housing 341, in a manner which permits the plane of lower surface 426 of sealing pad 423 to be deflected slightly from exact perpendicularity to the longitudinal axis of valve housing 341. Flexible mounting of seal holder body 416 to valve housing 341 enables flat lower surface 426 of sealing pad 423 to conform sealingly to the rim B of a container A which is tilted slightly with respect to the longitudinal axis of valve housing 341. The flexibility is provided by making the diameter of perforation 424 through seal holder body 416 slightly larger than the outer diameter of valve housing lower end 342, and positioning an upper attachment O-ring 427 between upper surface 417 of sealing body 416 and shoulder 344 of valve housing mid-section 343. Also, the outer cylindrical wall surface 428 of lower end portion 342 of valve housing 341 has formed therein an annular ring-shaped groove 429 located adjacent lower transverse end 430 of the lower end portion of the valve housing, the groove holding an O-ring 431 which secures the sealing body to the lower end portion of the valve housing. As shown in FIG. 21, one or more circular disk-shaped lower, volume adjustment washers 432 may be positioned between lower securement O-ring 431 and lower surface 426 of sealing pad 423. Volume adjustment washers 432 have a smaller outer diameter than sealing pad 423, and are adapted to be insertably received within the opening C of a container A, thus limiting the maximum fill volume of the container.

As is also shown in FIG. 21, one or more circular disk-shaped, upper, height adjustment washers 433 may be slipped over lower end portion 342 of valve housing 341, positioned between upper securement O-ring 427 and upper surface 417 of sealing body 416. The height adjustment washers 433 enable sealing body 416 to be located at adjustably greater distances from lower surface 344 of valve housing mid-section 343, to thereby accommodate shorter containers A.

Valve 32 is actuated from a closed position, in which valve stem 358 is biased to its uppermost sealed position by spring 398, as shown in FIG. 21, to a fully open position, by exerting a downward force on upper valve stem bumper 366, as shown in FIG. 22. A preferred structure for actuating a row of valves 32 in machine 31 may be best understood by referring to FIGS. 25 and 26, as well as FIGS. 21 and 22.

Referring first to FIGS. 21 and 22, it may be seen that valve housing 341 of valve 32 has protruding radially outwards therefrom, near the upper end of bushing 348, a support arm 435. Each support arm 435 is attached at an outer radial end thereof to a bracket 435A that has a tubular portion 436 having therethrough a pair of vertically disposed, circular bores 437 each of which is fitted with a guide bushing 438. Guide bushing 438 has an upper annular flange section 439 which seats against the upper annular edge wall 440 of tubular arm portion 436. Also, guide bushing 438 is preferably made of material which has a relatively low coefficient of surface sliding friction, such as nylon, and has through its length a vertically disposed bore 441. Bore 441 of bushing 438 vertically slidably receives a guide rod 442 which is fastened near an upper end thereof to a downwardly protruding rectangular plate 451 of an inverted L-bracket 450, which has a radially inwardly protruding horizontal leg plate 452 that is fastened to a fixed structural component(s) of machine 31. Also attached to upper horizontal plate 452 of L-bracket 450 is a pneumatic valve actuator cylinder 453. The latter has a vertically disposed cylinder housing 454, which has protruding vertically downwards therefrom a piston rod 455. Piston rod 455 has an externally threaded lower end portion 456 which is threadingly received within a blind vertically disposed bore 457 in the upper surface 459 of a generally square cross section, longitudinally elongated, horizontally disposed valve stem press bar 458. As shown in FIG. 22, downward extension of actuator cylinder piston rod 455 in response to pressurized air supplied to an extension port 459 of the actuator cylinder causes the lower surface 460 of valve stem press bar 458 to press downwards on the upper surface 461 of valve stem bumper 366.

Referring still to FIGS. 21 and 22, it may be seen that valve stem press bar 458 has attached to a right side vertical face 461 thereof a dogleg angle bracket 462 which includes a short, generally square-shaped vertically disposed upper plate section 463 which is secured to side vertical face 461 of press bar 458 by a screw 464 inserted through a hole 465 through upper plate section and tightened into a threaded blind bore 466 disposed horizontally inwards from the side vertical face of the press bar. Dogleg angle bracket 462 also includes a short, generally rectangularly-shaped middle plate section 467 which protrudes horizontally outwards from upper vertical plate section 463, and a relatively long, vertically elongated rectangularly-shaped outer vertical plate section 468 which protrudes vertically downwards from an outer edge of the middle plate section. Vertical plate section 468 of dogleg angle bracket 462 has attached to an outer vertical face 469 thereof a horizontally disposed, rectangular cross-section lift bar 470. As shown in FIGS. 21 and 22, lift bar 470 has a flat lower surface 471 coplanar with lower edge wall 472 of vertical plate section 468. Lift bar 470 has a generally flat, horizontally disposed upper surface 473 which is contactable against a lower surface 475 of a circular cross section bumper 474 which protrudes downwards from lower surface 476 of valve housing support bracket 435.

Pressure/vacuum fill valve 32 functions as follows. Product inlet port 404 and vacuum port 380 are connected through a pressure hose 500 and vacuum hose 501 to respective sources of pressurized liquid food product and vacuum. A container A is positioned on a support plate with its rim B coaxially aligned below sealing assembly 415 of valve 32. Air pressure is than applied to pneumatic actuator cylinder 453, causing piston rod 455 of the actuator to extend downwardly, as shown in FIG. 22; thus applying a downwardly directed force on valve stem bumper 366. This downwardly directed force is transmitted through compression spring 398 to valve housing 341, and sealing assembly 415, thus causing resilient sealing pad 423 of sealing assembly 415 to exert a compressive sealing force against the upper annular surface of the rim B of container A, and thereby limiting further downward movement of the valve housing. The magnitude of the sealing force is adjustable to higher or lower values by loosening set screw 391, lowering or raising collar 390, and re-tightening the set screw. Accordingly, further downward movement of valve stem press bar 458 causes valve stem 358 to move downwardly within valve housing 341, and thereby compress spring 398 as shown in FIG. 22. Downward movement of valve stem 358 within valve housing 341 causes angled lower end walls 432 of grooves 362 in the valve stem to extend outwards from bore 356 of lower tubular portion 342 of the valve housing. This extension in turn unseats valve stem O-ring 376 from lower annular end wall 377 of tubular portion 342 of the valve housing, thus creating a generally annularly-shaped opening 502, modified by the presence of ribs 363, as shown in FIGS. 22 and 23. Opening 502 communicates through longitudinally disposed grooves 362 in valve stem 358 with plenum 357, thus allowing pressurized liquid food product introduced through inlet port 404 into the plenum to be forced through the grooves and into the interior C of container A.

As shown in FIG. 22, air present within the interior C of container A is drawn into lower central entrance opening 379 of valve stem 358 and through bore 378 and vacuum port 381. Excess liquid food product introduced into the container is also exhausted by the same means. After a predetermined time period, the duration of which is determined empirically to be of the proper value to enable container A to be filled to a predetermined level with liquid food product, actuator cylinder 453 is energized to retract piston rod 455 and valve stem press bar 458 to an upper, home position as shown in FIG. 21.

Figure 22A:
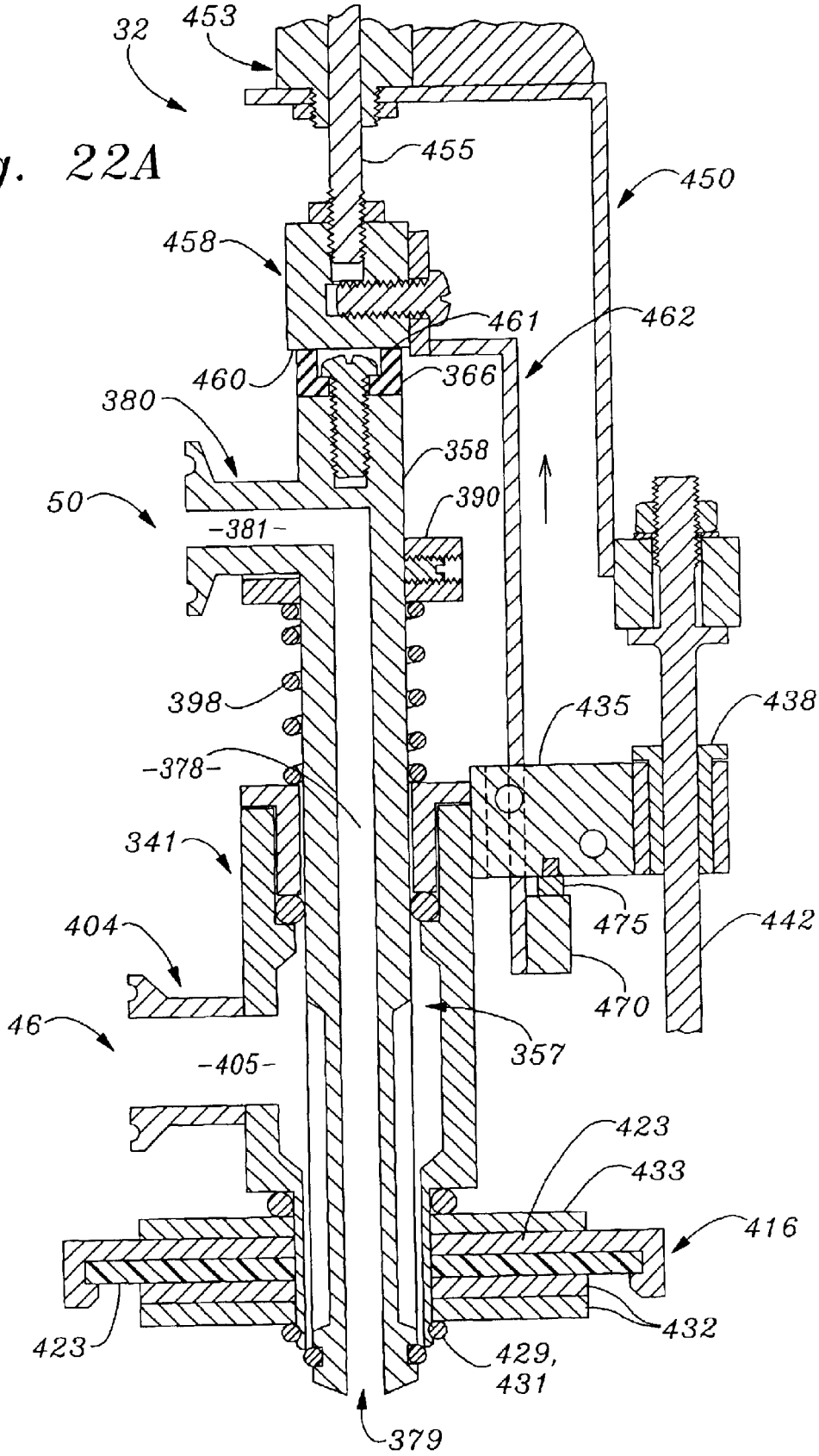
FIG. 22A is a view similar to that of FIG. 22, but with no container present.

As shown in FIGS. 22A and 26, if a container is missing from a fill station location below a particular fill head 32, sealing assembly 415 encounters no object to exert an upward reaction force thereon when valve stem 358 is depressed by valve stem press bar 458. In this case, valve stem 358 and valve housing 341 are translated downwards in unison, thereby causing valve 32 to remain in a closed state, and thus preventing dispensing of liquid food product from the valve. Also, in this case, lift bar 470 remains in contact with support bracket 435. When valve stem press bar 458 is elevated at the end of a container fill cycle, contact of lift bar 470 with valve housing support bracket 435 lifts the valve to its upward, home position.

FIGS. 27A–27D illustrate schematically various embodiments of an apparatus for filling containers with viscous liquid food products according to the present invention, in which various components of the invention which were described in detail above, are interconnected in different configurations.

Figure 27A:
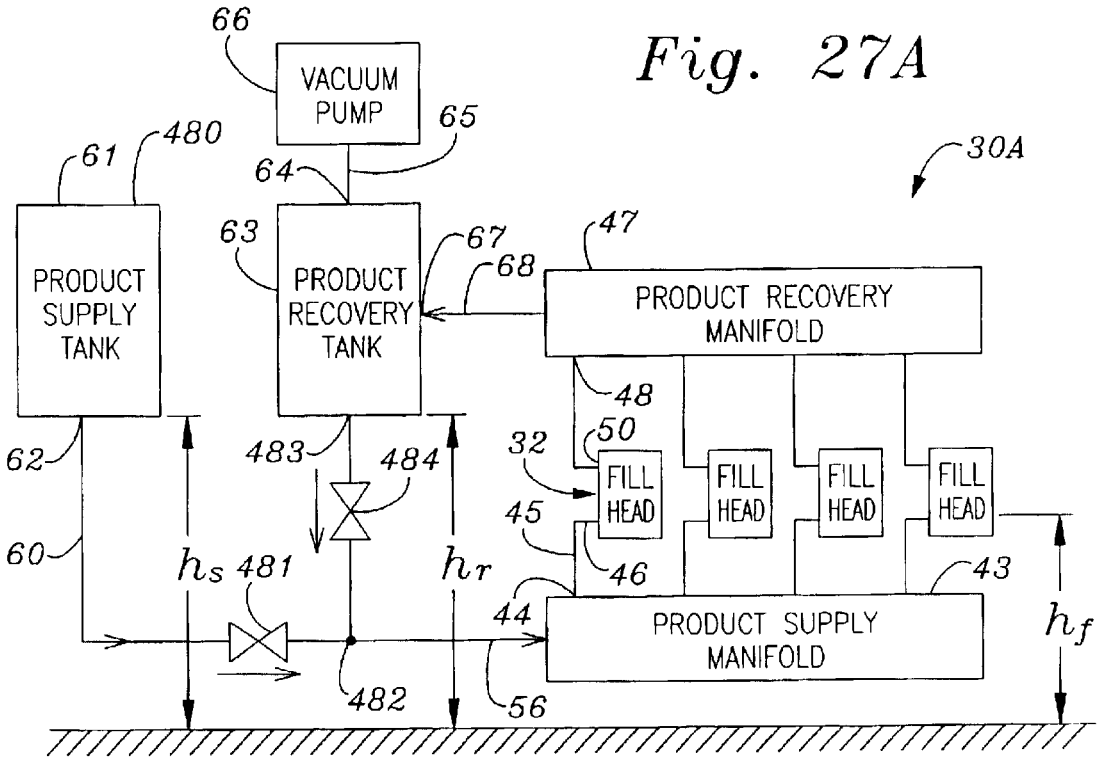

Embodiment 30A of apparatus 30 shown in FIG. 27A utilizes hydrostatic pressure of liquid food product contained in product supply tank 61 and product recovery tank 63 to supply liquid food product to inlet ports 46 of fill heads 32, thereby eliminating the requirement for a liquid product pump. This embodiment requires that the height $h_s$ of product supply tank 62, and $h_r$ of product recovery tank 63, both exceed the heights $h_f$ of inlet ports 46 of fill heads 32 by an amount equal to the hydrostatic pressure head required for a continuous flow of liquid product of a given viscosity to fill head input ports 46. As shown in FIG. 27A, liquid food product is supplied to product supply tank 61 through an inlet port 480. As is also shown in FIG. 27A, liquid food product flows through low pressure product supply hose 60 from outlet port 62 of product supply tank 61, and through a supply tank check valve 481 to a first inlet port of a Tee 482. Similarly, liquid food product flowing from an outlet port 483 of product recovery tank 63 flows through a recovery tank check valve 484 to a second inlet port of tee 482, an output port of which is connected through high pressure and product supply hose 56 to product supply manifold 43, and thence to inlet ports 46 of fill heads 32. As described above, excess liquid food product from containers being filled by fill heads 32 is drawn by vacuum from outlet; ports 50 of the heads into product recovery manifold 47, and thence through product recovery hose 68 to return inlet port 67 of product recovery tank 63, an upper portion of which tank is coupled through vacuum inlet port 64 and vacuum hose 65 to vacuum pump 66.

Figure 27B:
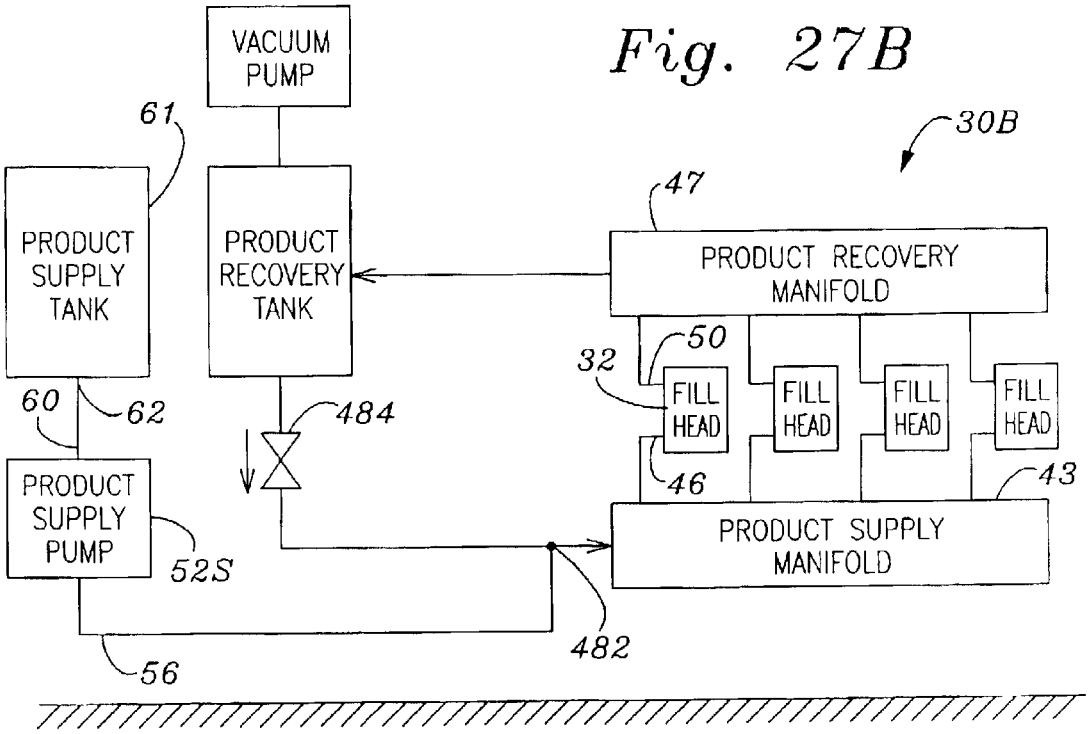

FIG. 27B illustrates an embodiment 30B of apparatus 30 which utilizes a product supply pump 52S, according to the present invention, positioned in series with low pressure product supply hose 60 from product supply tank 61, and high pressure product supply hose 56. High pressure product supply hose 56 is also connected through Tee 482 and product recovery check valve 484 to outlet port 483 of product recovery tank 63. Since product supply pump 52S has integral outlet check valves, no external check valve analogous to check valve 481 in FIG. 27A is required in this embodiment.

FIG. 27C illustrates a third; embodiment 30C of apparatus 30, which is substantially similar to embodiment 30B shown in FIG. 27B, but which replaces product recovery check valve 484 with a product recovery pump 52 R.

FIG. 27D shows a preferred embodiment 30D of apparatus 30, in which a product recovery pump 52R is positioned in series with product recovery tank 63 and product supply tank 61.

FIGS. 28 and 29 illustrate a preferred modification of an apparatus for filling containers with viscous liquid food products according to the present invention. Modified apparatus 30M, shown in FIGS. 28 and 29, utilizes a modified pressure/vacuum fill head 32A which eliminates certain components utilized in the basic embodiment 32 of a fill head described above.

As shown in FIGS. 28 and 29, the stem 358A of modified fill head 32A has affixed to the upper end thereof a bracket 566 which is clamped to press bar 458. Bracket 566 includes a rectangularly-shaped base plate 567 which is fastened to upper transverse end wall 568 of valve stem 358 by suitable means, such as a welded joint. Base plate 56 is disposed perpendicularly to the longitudinal axis of valve stem 358 and has protruding perpendicularly upwards from base plate 567 front and rear laterally centered studs 569, 570, respectively, which are fastened to front and rear end walls 567F, 567R, respectively of the base plate, by suitable means, such as welding. Bracket 566 also includes a cap plate 571 shaped similarly to base plate 567 and has through its thickness dimension front and rear laterally centered holes 572, 573, respectively. The latter are provided to receive the threaded upper ends of front and rear studs 569, 570.

As is also shown in FIGS. 28 and 29, bracket 566 of each valve stem 358 has formed between base plate 567 and front and rear studs 569, 570 a rectangular-shaped opening adapted to receive rectangular cross-section press bar 458. Bracket 566 of each fill head 32A is secured to press bar 458 by front and rear nuts 574, 575 threadingly tightened onto the threaded upper ends of front and rear studs 569, 570 which protrude through front and rear holes 572, 573 in cap plate 571. With this construction, valve stems 358A of a row of modified fill heads 32A are pushed downwardly to fill containers in the same manner as described above and depicted in FIGS. 25 and 26. However, at the end of a fill cycle, when press bar 458 is elevated to its upper, rest position, valve housing 341A is elevated to an upper, rest position by coupling between the housing and the valve stem through valve spring 398, thereby elevating the housing in unison with the valve stem. Thus, modified fill head 32A eliminates the requirement for valve housing bracket 435, lift bar 470 and its associated components, and bracket 450 and its associated components.

What is claimed is:

1. An apparatus for filing containers with liquid products having different viscosities, said apparatus comprising:

a. a loading platform for supporting a plurality of containers, b. a plurality of container fill heads, said fill heads including a housing having an inlet for receiving the liquid product and a plenum for receiving therein a valve stem, said valve stem having a plurality of longitudinally disposed, circumferentially spaced apart grooves formed in an outer cylindrical wall surface thereof, said grooves terminating at a lower end thereof in a cylindrical boss, said valve stem being adapted for reciprocating movement between an upward position forming a seal between said valve stem and said housing and a downward position releasing said seal to thereby form an opening from which the liquid product flows under pressure through said grooves and said opening into a respective container, c. a filling platform for supporting the plurality of containers beneath said fill heads, d. product transport means for transporting the liquid product to said fill heads, e. fill head container sealing means for temporarily forming a liquid pressure-tight seal between each of said fill heads and an interior space of a respective container, f. fill head actuator means for causing the liquid product supplied to said fill heads to flow into and fill the interior space of a respective container, g. fill head exhaust means for exhausting excess liquid product and air from a respective container, said fill head exhaust means including a vacuum bore having a lower portion disposed longitudinally and coaxially through said valve stem from a lower end face of said valve stem, and an upper portion disposed radially outwardly from an upper end of said lower portion through a radially disposed neck penetrated by said upper portion of said vacuum bore, and h. container loading translation means for moving the containers from said loading platform to said container support platform into vertical alignment beneath a respective fill head.

2. The apparatus of claim 1 wherein said fill head container sealing means further comprises a sealing assembly which includes a seal body coaxially penetrated by and attached to a lower portion of a respective fill head, said seal body having a lower annular surface to which is affixed a resilient annular ring-shaped sealing pad for sealingly contacting an upper transverse surface of a container rim which encircles an opening of the container when said seal body is pressed downwardly against the container rim.

3. The apparatus of claim 1 wherein said fill head actuator means further comprises a valve stem bumper attached to an upper end of said valve stem protruding outwardly from said fill head housing.

4. The apparatus of claim 1 wherein said fill head actuator means further comprises valve stem coupling means for coupling said valve stem protruding outwardly from said valve housing to a valve stem force actuator means for exerting a downward force on said valve stem which thereby initially presses said resilient sealing pad of said sealing assembly into sealing contact with the rim of the container, and subsequently presses down on said valve stem against said bias means to thereby form said annular-shaped opening.

5. The apparatus of claim 4 wherein said valve stem coupling means further comprises a bracket means attached to an upper end portion of said valve stem.

6. The apparatus of claim 5 wherein said valve stem force actuator means further comprises a power actuator which has coupled to an output linkage rod thereof a valve stem press bar fastenable to said bracket means, said valve stem press bar being reciprocatingly actuable by said power actuator cylinder to alternatively exert a downwardly directed force and an upwardly directed force on said valve stem.

7. The apparatus of claim 1 wherein said product transport means further comprises a product supply tank having at a lower end thereof an outlet port located at a predetermined supply tank outlet port height above the height of said product inlet port on said fill heads sufficient to produce a predetermined minimum supply tank elevation hydrostatic pressure head, and a hose connection between said supply tank outlet port and said fill head inlet port.

8. The apparatus of claim 2 further comprising product recovery means including:

a. a product recovery tank having a vacuum inlet port, a recovered product inlet port, and a recovered product outlet port, b. a vacuum pump connected to said vacuum inlet port of said product recovery tank, and c. a product recovery hose which connects said fill head outlet port to said recovered product inlet port of said product recovery tank, said inlet port communicating with an interior space of said product recovery tank which communicates with said vacuum inlet port of said product recovery tank, wherein said vacuum pump, product recovery tank, and hose comprise said vacuum source sealingly connected to said fill head.

9. The apparatus of claim 8 wherein said product transport means further comprises:

a. a product supply tank having at a lower end thereof an outlet port located at a predetermined supply tank outlet height above the height of said product inlet port on said fill head sufficient to produce a predetermined minimum supply tank elevation hydrostatic pressure head capable of dispensing liquid product from said fill head into said container at a predetermined minimum fill rate, b. said outlet port of said product recovery tank located at a height sufficient to produce a predetermined minimum product recovery tank elevation pressure head at said fill head inlet port, and c. product stream combining means for combining liquid product flow streams from said product supply tank and said product recovery tank, respectively, for dispensing from said fill head.

10. The apparatus of claim 9 wherein said product stream combining means further comprises:

a. a coupling mechanism having an outlet port connected to said product inlet port of said fill head, and first and second inlet ports, b. a first product supply tank source line coupled through a first check valve between said product supply tank outlet port and said first inlet port of said coupling mechanism, and c. a second product recovery tank source line coupled through a second check valve between said product recovery tank outlet port and said second inlet port of said coupling mechanism.

11. The apparatus of claim 10 further comprising a first product supply pump inserted in series in said product supply tank source line and having an inlet port coupled to said product supply tank outlet port and an outlet port connected to said first inlet port of said coupling mechanism.

12. The apparatus of claim 11 further comprising second product recovery pump inserted in series in said product recovery tank source line and having an inlet port coupled to said product recovery tank outlet port and an outlet port connected to said second inlet port of said coupling mechanism.

13. The apparatus of claim 11 wherein said product transport means further comprises a product supply tank and a first product supply pump, said first product supply pump having an inlet port connected to an outlet port of said product supply tank and said first product supply pump having an outlet port connected to said inlet port of said fill head.

14. The apparatus of claim 13 further comprising a second product recovery pump having an inlet port connected to said recovered product outlet port of said second product recovery tank, and an outlet port connected to an inlet port of said second product supply tank.

15. The apparatus of claim 13 wherein said first product supply pump comprises a double action piston pump which includes:

a. a hollow cylinder sealed at a first transverse end thereof by a first end plate, and at a second end thereof by a second transverse end plate, said cylinder having a cylindrical wall enclosing a cylindrical bore disposed longitudinally between said first and second end walls.

16. The apparatus of claim 1 further comprising inlet conveyor means for conveying a plurality of empty containers to said loading platform.

17. The apparatus of claim 1 further comprising outlet conveyor means for conveying filled containers away from said unloading platform.

18. The apparatus of claim 1 wherein said container inlet translation means further comprises an elongated arm located adjacent to said loading platform opposite said filling platform, and force actuator means for reciprocating said arm between a first position towards said filling platform to a first index position for empty containers on said loading location platform to be translated into a filling position on said filling platform beneath said fill heads and a second position retracting said arm thereafter to a home position outboard of said loading platform.

19. The apparatus of claim 18 wherein said container outlet translation means is adapted to move said arm inwardly against an empty container to thereby cause said empty container to abut and move a filled container from said filling platform onto said unloading platform.

20. The apparatus of claim 3 further comprising a valve stem actuator means for exerting a downward force on said valve stem bumper which thereby initially presses said resilient sealing pad of said sealing assembly into sealing contact with the rim of said container, and subsequently presses down on said valve stem against said bias means to thereby push said lower boss end of said valve stem downwardly out from said fill head housing to thereby form said liquid product exit opening.

21. The apparatus of claim 20 further comprising valve lifting means for lifting said valve stem upwardly away from the container upon completion of a container filling cycle.

22. The apparatus of claim 20 wherein said valve stem actuator means further comprises a reciprocating power actuator cylinder having a piston rod coupled at a lower end thereof to a valve stem press bar located above said valve stem bumper, a valve stem support arm which protrudes radially outwardly from said valve stem, and a lift bar structure including a bracket mechanism fastened at an upper end thereof to said valve stem press bar.

23. The apparatus of claim 22 wherein said bracket mechanism has a vertically disposed plate section including a horizontally disposed lift bar fastened perpendicularly thereto at a lower end thereof, said lift bar being positioned beneath said valve stem support arm such that downward motion of said power actuator cylinder piston rod forces said valve stem press bar downwardly against said valve stem bumper, and upward motion of said power actuator piston rod and said valve stem press bar causes said lift bar to move upwardly to contact a lower surface of said valve stem lift arm and thereby lift said valve stem lift arm and valve stem to an upward closed position.

24. The apparatus of claim 15, wherein said bore is adapted to receive therein a piston having attached at a rear transverse end face thereof a piston rod which protrudes coaxially within said bore through a perforation in said second end plate in sealing contact within said perforation, said piston rod being reciprocable in response to an external pump piston rod force actuator for reciprocating said piston between front and rear longitudinal travel limits within said bore of said cylinder.

25. The apparatus of claim 24, wherein said cylinder wall has disposed radially therethrough a first front port which is located forward of the forward travel limit of said piston and which communicates with a portion of said bore forward of said piston, and a second rear port which is located rearward of said rear longitudinal travel limit of said piston and which communicates with a portion of said bore rearward of said piston.

26. The apparatus of claim 25, wherein said first front port and said second rear port are connected through separate ones of a pair of inlet check valves to an inlet manifold, and through separate ones of a pair of outlet check valves to an outlet manifold, whereby forward reciprocating motion of said piston within said cylinder draws in liquid product through said rear inlet check valve into said cylinder bore while simultaneously expelling liquid product through said front outlet check valve, and rearward reciprocating motion of said piston within said cylinder draws in liquid product through said front inlet check valve while simultaneously expelling liquid product through said rear outlet check valve.

27. The apparatus of claim 26 wherein said check valve further comprises:

a. a check valve housing, said check valve housing having located longitudinally inwards of an outlet end thereof a transversely disposed, perforated valve stem support spider, b. a check valve body having a lower end portion and a concentric valve stem which protrudes perpendicularly upwards from said lower end portion, said lower end portion having located in an outer cylindrical wall surface thereof an annular ring-shaped groove which holds an O-ring, c. a radially inwardly and downwardly tapered valve seat formed within a inner cylindrical wall surface of said valve housing near a lower, inlet transverse end thereof, and d. second bias means for biasing said valve body downwards within said check valve housing to thereby force said O-ring in said check valve body into resilient, liquid pressure-tight sealing contact with said valve seat.

28. An apparatus for filling a plurality of containers with a liquid product, said apparatus comprising:

a plurality of platform stations aligned in parallel for supporting the containers before, during, and upon completion of a container filling cycle, a plurality of fill heads for simultaneously filling the containers during the container filling cycle, each of said fill heads including:

a housing having an inlet port for receiving the liquid product from a liquid product source, a valve stem received in an annular cavity of said housing, said valve stem having a plurality of longitudinally disposed, circumferentially spaced apart grooves formed in an outer cylindrical wall surface thereof, said grooves terminating at a lower end thereof in a cylindrical boss, said valve stem being adapted for reciprocating movement between an upward position forming a seal between said valve stem and said housing and a downward position releasing said seal to thereby form an opening from which the liquid product flows under pressure through said grooves and said opening and in a respective container, a bias mechanism for biasing said valve stem between said open position and said closed position, a sealing mechanism for forming a liquid pressure-tight seal between said fill heads and an interior space of a respective one of said containers, said sealing mechanism including means for adjusting the magnitude of the sealing force between said fill heads and the containers, an actuator mechanism for causing said valve stem to move between said open and closed positions, an exhaust mechanism for exhausting excess liquid product and air from said container.

29. An apparatus for filling a plurality of containers with liquid product of different viscosities, said apparatus comprising:

a plurality of platform stations aligned in parallel for supporting the containers before during, and upon completion of a container filling cycle;

a translation mechanism for moving the containers between said platform stations; and a plurality of fill heads for simultaneously filling the containers during the container filling cycle, each one of said fill heads including a fill head body for receiving a valve stem therein, said valve stem having a plurality of grooves formed at an outer surface thereof, said valve stem being adapted for reciprocating movement between an upward position fanning an adjustable seal between said valve stem and said fill head body and a downward position releasing said seal to thereby form an opening from which the liquid product flows under pressure through said grooves and said opening and into a respective container, and fill head exhaust means for exhausting excess liquid product and air from a respective container, said fill head exhaust means including a vacuum bore with a lower portion disposed longitudinally and coaxially through said valve stem, and an upper portion disposed radially outwardly from an upper end of said lower portion.

* * * * *